US009427051B2

(12) United States Patent
Hsu et al.

(10) Patent No.: US 9,427,051 B2
(45) Date of Patent: Aug. 30, 2016

(54) SLIDER FOR SLIDE FASTENER

(75) Inventors: Hsien Hsiang Hsu, Taipei (TW); Morimasa Yoneoka, Taipei (TW)

(73) Assignee: YKK Corporation (JP)

( * ) Notice: Subject to any disclaimer, the term of this patent is extended or adjusted under 35 U.S.C. 154(b) by 183 days.

(21) Appl. No.: 13/521,334

(22) PCT Filed: Jan. 18, 2010

(86) PCT No.: PCT/JP2010/050509
§ 371 (c)(1),
(2), (4) Date: Jul. 10, 2012

(87) PCT Pub. No.: WO2011/086703
PCT Pub. Date: Jul. 21, 2011

(65) Prior Publication Data
US 2012/0291235 A1 Nov. 22, 2012

(51) Int. Cl.
*A44B 19/26* (2006.01)

(52) U.S. Cl.
CPC ..... *A44B 19/26* (2013.01); *Y10T 24/2582* (2015.01)

(58) Field of Classification Search
CPC ..... A44B 19/26; Y10T 24/2582
See application file for complete search history.

(56) References Cited

U.S. PATENT DOCUMENTS

| | | | | |
|---|---|---|---|---|
| 2,160,160 | A | 5/1939 | Marinsky et al. | |
| 2,181,142 | A | 11/1939 | Marinsky et al. | |
| 4,624,032 | A * | 11/1986 | Ishii et al. | 24/429 |
| 4,780,938 | A * | 11/1988 | Ishii | 24/429 |
| 5,551,129 | A * | 9/1996 | Chu | 24/429 |
| 5,991,982 | A | 11/1999 | Wakabayashi et al. | |
| 7,506,417 | B2 * | 3/2009 | Yoneoka | 24/430 |
| 7,652,579 | B2 * | 1/2010 | Keyaki et al. | 340/572.8 |
| 7,870,650 | B2 * | 1/2011 | Keyaki et al. | 24/424 |
| 2007/0033776 | A1 | 2/2007 | Yoneoka | |
| 2008/0196218 | A1 | 8/2008 | Yamagishi et al. | |

FOREIGN PATENT DOCUMENTS

| | | | |
|---|---|---|---|
| JP | 10-295415 | A | 11/1998 |
| JP | 2007-44535 | A | 2/2007 |
| JP | 2008-200277 | A | 9/2008 |
| JP | 3078062 | U | 3/2012 |
| JP | 3070213 | U | 4/2012 |

OTHER PUBLICATIONS

International Search Report and Written Opinion, PCT International Application No. PCT/JP2010/050509, mailed Apr. 20, 2010.

* cited by examiner

*Primary Examiner* — Robert J Sandy
*Assistant Examiner* — Louis Mercado
(74) *Attorney, Agent, or Firm* — Kilpatrick Townsend & Stockton LLP

(57) ABSTRACT

A slider is structured such that a tab attaching rod is integrally formed in a cantilevered state in an upper blade of a slider body, and a blocking member blocking an insertion gap which is formed between the upper blade and a free end portion of the tab attaching rod is engaged with a mounting portion of the slider body so as to be immovably fixed, and is provided with an occlusion retaining structure which retains a blocked state of the insertion gap at a time of fixing the blocking member and can prevent the other member from intruding into the insertion gap. Accordingly, the slider can easily attach a tab afterward to the tab attaching rod. Further, it is possible to securely prevent the other member from intruding between the upper blade and the free end portion of the tab attaching rod.

13 Claims, 13 Drawing Sheets

SLIDER FOR SLIDE FASTENER

This application is a national stage application of PCT/JP2010/050509 which is incorporated herein by reference.

TECHNICAL FIELD

The invention relates to a slider for a slide fastener, and particularly to a slider for a slide fastener of a type that a tab is attached afterward to a slider body after manufacturing the slider body.

BACKGROUND ART

Conventionally, a slider in which a tab can be attached afterward to a slider body after manufacturing the slider body has been known as one of sliders which are used in a slide fastener. The slider mentioned above can be preferably used in a slide fastener, for example, attached to clothing item, bags and the like, since various types of tabs which are different in colors and shapes can be freely attached to the slider body, for example, in correspondence to a request, a preference and the like of a user.

One example of the slider for the slide fastener in which the tab can be attached afterward as mentioned above is disclosed, for example, in Japanese Patent Application Laid-Open No. 10-295415 (Patent Document 1), Japanese Utility Model No. 3070213 (Patent Document 2), Japanese Utility Model No. 3078062 (Patent Document 3) and the like. In this case, a description will be given of the slider described in the Patent Document 1 with reference to FIG. 20.

A slider 101 described in the Patent Document 1 has a slider body 110, a tab 120 which is attached to the slider body 110, a stopper (a blocking member) 130 and a resilient member 140 which are accommodated in a hole portion 117 pierced in a height direction of the slider body 110, and a tabular support plate 150 which is fixed by caulking to the slider body 110 and supports the resilient member 140.

The slider body 110 has upper and lower blades 111 and 112, a diamond 113 which connects front end portions of the upper and lower blades 111 and 112, upper and lower flanges 114 which are arranged in right and left side edges of the upper and lower blades 111 and 112. Further, a tab attaching rod 160 which is raised in a cantilevered state is integrally formed with the slider body 110 in an upper surface of the upper blade 111. In this case, one end portion of the tab attaching rod 160 corresponds to a fixed end portion which is fixed to the upper blade 111, and another end portion corresponds to a free end portion 161 which is arranged so as to have a gap with respect to the upper surface of the upper blade 111. Note that, the gap arranged between the upper surface of the upper blade 111 and the free end portion 161 of the tab attaching rod 160 corresponds to an insertion gap for inserting a part of the tab 120 at a time of attaching the tab 120 to the tab attaching rod 160, as mentioned below.

Right and left shoulder ports are formed in a front end of the slider body 110 so as to have the diamond 113 between them, and a rear port is formed in a rear end of the slider body 110. Further, a Y-shaped element guide path 115 communicating the right and left shoulder ports and the rear port is formed between the upper and lower blades 111 and 112.

In the slider body 110, a concave portion 116 is formed in an upper surface of the upper blade 111 so as to head for a rear side from a front end edge of the upper blade 111, and the concave portion 116 is arranged in a wider range than the free end portion 161 in a lower side of the free end portion 161 of the tab attaching rod 160.

Further, a hole portion 117 passing through in an up and down direction from an upper surface of the upper blade 111 to a lower surface of the lower blade 112 is pieced in a front end portion in which the diamond 113 of the slider body 110 is arranged, and a lower end of the hole portion 117 is provided with a step portion which can fit the support plate 150. Further, a protruding piece portion 118 which can fix the support plate 150 by caulking is provided in a hanged manner at the front and back position of the hole portion 117 in the lower blade 112.

The tab 120 in the Patent Document 1 has a tab main body portion 121, and an attaching shaft portion 122 which is inserted in an accommodating space formed between the upper blade 111 and the tab attaching rod 160.

An inclined surface 131 is formed in an upper end portion of the stopper 130 in the Patent Document 1. The inclined surface 131 is arranged in such a manner that the stopper 130 is inclined downward to a forward side at a time of being fitted to the slider body 110. Further, a circular hole portion (not shown) which can insert the resilient member 140 is formed in a lower end surface of the stopper 130.

In the case of assembling the slider 101 of the Patent Document 1 having the parts as mentioned above, first of all, the stopper 130 is inserted at a predetermined direction into the hole portion 117 which is pierced in the slider body 110, and the resilient member 140 is arranged below the stopper 130. At this time, an upper end of the resilient member 140 is fitted into a circular hole portion (not shown) in the stopper 130.

Subsequently, the support plate 150 is fixed to the slider body 110 by fitting the support plate 150 to the step portion which is arranged in the lower end of the hole portion 117 in a state in which the support plate 150 is brought into contact with the lower end of the resilient member 140, and further caulking the protruding piece portion 118 hanged from the lower blade 112 toward the support plate 150. In accordance with this, the stopper 130, the resilient member 140 and the support plate 150 are mounted to the slider body 110.

At this time, since the stopper 130 is energized upward by the resilient member 140, the upper end of the stopper 130 comes into contact with the free end portion 161 of the tab attaching rod 160, thereby coming to a state in which a gap (an insertion gap) provided between the bottom surface of the concave portion 116 formed in the upper blade 111 and the free end portion 161 of the tab attaching rod 160 is blocked.

Next, the tab 120 is attached to the slider body 110 to which the stopper 130, the resilient member 140 and the support plate 150 are mounted. Specifically, the attaching shaft portion 122 of the tab 120 is inserted between the concave portion 116 formed in the upper blade 111 and the free end portion portion 161 of the tab attaching rod 160 from a front end side of the slider body 110, the attaching shaft portion 122 is brought into contact with the inclined surface 131 of the stopper 130, and the attaching shaft portion 122 is pressed toward the stopper 130.

In accordance with this, since the stopper 130 moves downward against an energizing force of the resilient member 140, the insertion gap between the bottom surface of the concave portion 116 of the upper blade 111 and the free end portion portion 161 of the tab attaching rod 160 is opened, and the attaching shaft portion 122 of the tab 120 is introduced into an accommodating space which is formed between the upper blade 111 and the tab attaching rod 160 via the opened insertion gap, and is accommodated into the accommodating space.

Since the stopper 130 is energized by the resilient member 140 so as to move upward after the attaching shaft portion 122 of the tab 120 is introduced into the accommodating space, the upper end of the stopper 130 comes into contact with the free end portion 161 of the tab attaching rod 160, thereby coming to a state in which the insertion gap is again blocked. In accordance with this, the slider 101 in which the tab 120 is attached to the tab attaching rod 160 can be obtained.

In accordance with the slider 101 of the Patent Document 1 mentioned above, it is possible to easily and smoothly attach the tab 120 to the slider body 110 in which the tab attaching rod 160 is integrally formed, by utilizing the concave portion 116 which is formed in the upper blade 111 of the slider body 110.

Further, in the slider 101, since the gap between the upper surface of the upper blade 111 and the free end portion 161 of the tab attaching rod 160 becomes smaller, it is possible to make it hard for the attaching shaft portion 122 of the tab 120 to enter into the gap between the bottom surface of the concave portion 116 in the upper blade 111 and the free end portion 161 of the tab attaching rod 160, in the case that the tab 120 is once attached to the tab attaching rod 160.

In accordance with this, it is possible to reduce a possibility that the attaching shaft portion 122 of the tab 120 comes into contact with the stopper 130 so as to press the stopper 130, at a time when the tab 120 is pulled, for example, by an operation of the slider 101 or the like. Therefore, it is possible to prevent such a trouble that the tab 120 is disconnected arbitrarily from the tab attaching rod 160 without user's intention.

On the other hand, in the sliders disclosed in the Patent Documents 2 and 3, an insertion gap which can insert an attaching shaft portion of a tab is provided between an upper surface of an upper blade in a slider body and a free end portion of a tab attaching rod, and a leaf spring member is used as a blocking member which blocks the insertion gap.

In the slider mentioned above, in the case that the tab is attached to the tab attaching rod which is arranged in the slider body after mounting the blocking member constructed by the leaf spring member to the slider body so as to block the insertion gap, the blocking member resiliently deforms and can easily make the insertion gap open, by pressing the blocking member by the attaching shaft portion of the tab. In accordance with this, since the attaching shaft portion of the tab is smoothly introduced to the tab accommodating space between the upper blade and the tab attaching rod, via the opened insertion gap, it is possible to easily carry out the attachment of the tab.

PRIOR ART DOCUMENT

Patent Document

Patent Document 1: Japanese Patent Application Laid-Open No. 10-295415

Patent Document 2: Japanese Utility Model No. 3070213

Patent Document 3: Japanese Utility Model No. 3078062

SUMMARY OF THE INVENTION

Problems to be Solved by the Invention

In the slider described in the Patent Document 1 to 3, as mentioned above, the stopper or the blocking member is mounted to the slider body, and blocks the insertion gap which is arranged between the upper blade of the slider body and the free end portion of the tab attaching rod. Thereafter, the insertion gap in the occluded state is opened by moving the stopper against an energizing force of the resilient member, or resiliently deforming the blocking member itself, and the attaching shaft portion of the tab is introduced to the tab accommodating space via the opened insertion gap. In accordance with this, it is possible to afterward attach the tab to the tab attaching rod which is arranged in the slider body.

However, in the conventional slider which can carry out an afterward attachment of the tab as mentioned above, there was such a problem that the other member such as a thin patching or the like which accidentally exists in a peripheral portion of the slider entered into and was pinched by the insertion gap of the slider, at a time when the slide fastener having the slider was attached to the product of the clothes and the bags so as to be used.

In a specific description, for example, in the case that the slide fastener is used in the clothes, the other members such as the thin patching or the like may be inserted toward the insertion gap from the outside of the slider by some chance at a time of wearing the clothes so as to exercise. Alternatively, for example, even in the case that the slide fastener is used in the bag, the other members such as the thin patching or the like may be inserted toward the insertion gap of the slide by some chance at a time of moving the bag or sliding the slider of the slide fastener so as to open and close an opening portion of the bag.

In this case, the insertion gap of the slider is retained in the state of being blocked by the stopper or the blocking member, however, the other member inserted to the insertion gap enters into the insertion gap while directly pressing the stopper or the blocking member of the slider so as to open the insertion gap. Further, on the basis of a force by which the stopper or the blocking member is going to return to the original blocked state, there is a case that the other member is pinched (bitten) between the stopper or the blocking member and the free end portion of the tab attaching rod.

Further, since there are problems that the clothes or the bags are pulled by the other member or a sliding operation of the slider is prevented by the other member, due to a matter that the thin other member is pinched in the slider as mentioned above, solution to the problems has been sought.

The invention is made by taking the conventional problem mentioned above into consideration, and a particular object of the invention is to provide a slider for a slide fastener which can easily attach a tab afterward to a tab attaching rod arranged in a slider body, and can prevent the other member such as a thin patching or the like from being pinched between an upper blade of the slider body and a free end portion of the tab attaching rod.

Means for Solving the Problems

In order to achieve the object mentioned above, a slider for a slide fastener provided by the invention is a slider for a slide fastener in which a tab attaching rod retaining a tab is integrally formed in a cantilevered state on an upper surface of an upper blade of a slide body having upper and lower blades, the tab attaching rod has a fixed end portion which rises from the upper blade, and a free end portion which is provided with an insertion gap capable of inserting a part of the tab with respect to the upper blade, and a blocking member blocking the insertion gap is arranged in the slider body, as a basic structure, being most mainly characterized in that the slider body has an mounting portion to which the blocking member is mounted, and the blocking member is provided with an occlusion retaining structure which is mounted to the mounting portion so as to be immovably fixed, retains a blocked state of the insertion gap at a time of fixing the blocking member and is capable of preventing the other member from intruding into the insertion gap.

In the slider for the slide fastener in accordance with the invention, it is preferable that the tab attaching rod has a fixing portion which engages at least a part of the blocking member mounted to the mounting portion so as to fix the blocking member, in the free end portion, the blocking member has a main body portion which is mounted to the mounting portion, a resilient piece portion which is extended from the main body portion and is resiliently deformable in an up and down direction, and an engaging and disengaging portion which is arranged in the resilient piece portion and is capable of engaging with and disengaging from the fixing portion, and the occlusion retaining structure is constructed by a regulation of a resilient deformation in the up and down direction of the resilient piece portion.

In this case, it is preferable that the fixing portion is constructed by a step portion which is arranged in the free end portion, the resilient piece portion is arranged in such a manner that a part of the resilient piece portion is in contact with or close to the free end portion of the tab attaching rod, the engaging and disengaging portion is constructed by a protruding portion which protrudes to an upper surface of the resilient piece portion, and the occlusion retaining structure is structured such that a resilient deforming amount of the resilient piece portion is regulated to such a magnitude that an upper end of the protruding portion is movable to a height position of a lower end of the step portion.

Particularly, in this case, it is preferable that the mounting portion is constructed by a concave groove which is arranged in the upper surface of the upper blade. Further, it is preferable that the blocking member has a pair of shoulder portions which are arranged while holding the resilient piece portion between them, and the resilient piece portion and the protruding portion are arranged within a region between the pair of shoulder portions. Further, it is preferable that a concave portion is arranged in an upper surface of the resilient piece portion.

Further, in the slider for the slide fastener in accordance with the invention, the fixing portion may be constructed by a projection portion which protrudes from the free end portion of the tab attaching rod, the resilient piece portion may be arranged so as to be curved into an S-shape from the main body portion toward the free end portion of the tab attaching rod, the engaging and disengaging portion may be constructed by a hole portion which is pieced in a leading end portion of the resilient piece portion, and the occlusion retaining structure may be structured such that the projection portion is inserted to the hole portion and a leading end portion of the resilient piece portion is fixed to the free end portion, whereby a resilient deformation of the resilient piece portion is regulated.

In this case, it is preferable that the mounting portion is constructed by a dovetail groove which is arranged in the upper surface of the upper blade. Further, it is preferable that the blocking member has a pair of leg portions which are bifurcated from the main body portion so as to be extended, and are resiliently deformable in a slider width direction, and a protruding piece portion which protrudes in a direction of being spaced from each other in the leading ends of the leg portions, and the upper surface of the upper blade is provided in a protruding manner with a pair of protruding portions which lock the protruding piece portion of the blocking member which is mounted to the mounting portion.

Further, in the slider for the slide fastener in accordance with the invention, the blocking member may have a main body portion which is mounted to the mounting portion, and a blocking portion which is provided in a blocking manner on an upper surface of the main body portion and comes into contact with the free end portion of the tab attaching rod at a time of installing and fixing the blocking member, and the occlusion retaining structure may be constructed by the blocking portion.

In this case, it is preferable that the mounting portion is constructed by a dovetail groove which is arranged in the upper surface of the upper blade. Further, it is preferable that the blocking member has a pair of leg portions which are bifurcated from the main body portion so as to be extended, and are resiliently deformable in a slider width direction, and a protruding piece portion which protrudes in a direction of being spaced from each other in the leading ends of the leg portions, and the upper surface of the upper blade is provided in a protruding manner with a pair of protruding portions which lock the protruding piece portion of the blocking member which is mounted to the mounting portion.

Effect of the Invention

In the slider for the slide fastener in accordance with the invention, the tab attaching rod is integrally formed in a cantilevered state on the upper surface of the upper blade of the slide body, the blocking member blocking the insertion gap formed between the upper blade and the tab attaching rod is installed to the mounting portion of the slider body so as to be immovably fixed. Further, the slider is provided with the occlusion retaining structure which can retain the blocked state of the insertion gap so as to prevent the other member from intruding into the insertion gap at a time when the blocking member is fixed to the mounting portion of the slider body.

In accordance with the slider of the invention having the structure mentioned above, it is possible to retain the tab to the tab attaching rod by inserting a part of the tab into the insertion gap which is provided between the upper blade and the free end portion of the tab attaching rod, after forming the slider body which integrally has the tab attaching rod. The insertion gap is blocked and the attachment of the tab is finished by further thereafter installing the blocking member to the mounting portion of the slider body so as to fix. As mentioned above, in the slider in accordance with the invention, it is possible to easily attach the tab afterward to the tab attaching rod which is arranged in the slider body.

Further, since the slider in accordance with the invention is provided with the occlusion retaining structure, it is possible to retain the blocked state of the insertion gap which is provided between the upper blade and the free end portion of the tab attaching rod, after the tab is attached and the blocking member is mounted to the slider body so as to be immovably fixed. In accordance with this, it is possible to securely prevent the other member such as the thin patching from intruding between the upper blade and the free end portion of the tab attaching rod so as to be pinched.

Accordingly, it is possible to prevent the problem caused by the other member being pinched by the slider, for example, the clothes or the bags from being pulled by the other member, and the sliding operation of the slider from being obstructed by the other member, in the case that the slide fastener having the slider is attached to the product such as the clothes or the bags so as to be used.

Note that, the blocked state of the insertion gap referred in the invention means a state in which the blocking member is positioned between the upper blade of the slider body and the free end portion of the tab attaching rod, whereby the insertion gap is completely blocked by the blocking member, and an accommodating space of the attaching shaft portion of the tab formed between the upper blade of the slider body and the tab attaching rod is interrupted.

Further, in the slider in accordance with the invention, a method for attaching the tab to the tab attaching rod is not particularly limited. For example, the attachment of the tab can be carried out by mounting the blocking member to the mounting portion of the slider body so as to fix after retaining the tab to the tab attaching rod, as mentioned above. Further, in addition, it is possible to carry out the attachment of the tab by mounting the blocking member to the mounting portion of the slider body before retaining the tab to the tab attaching rod, thereafter retaining the tab to the tab attaching rod via the insertion gap, and fixing the blocking member to the slider body.

In the slider in accordance with the invention mentioned above, the tab attaching rod has the fixing portion which engages at least a part of the blocking member mounted to the mounting portion so as to fix the blocking member, in the free end portion. Further, the blocking member has the main body portion which is mounted to the mounting portion, the resilient piece portion which is extended from the main body portion and is resiliently deformable in the up and down direction, and the engaging and disengaging portion which is arranged in the resilient piece portion and can engage with and disengage from the fixing portion. Further, the occlusion retaining structure is constructed by the regulation of the resilient deformation in the up and down direction of the resilient piece portion.

In accordance with the slider of the invention in which the tab attaching rod, the blocking member and the occlusion retaining structure are structured as mentioned above, it is possible to stably fix the blocking member which is mounted to the mounting portion at a predetermined position by resiliently deforming the resilient piece portion of the blocking member so as to engage the engaging and disengaging portion of the blocking member to the fixing portion of the tab attaching rod. Further, in the slider, since the occlusion retaining structure is structured by the regulation of the resilient deformation in the up and down direction of the resilient piece portion, it is possible to easily retain the state in which the blocking member blocks the insertion gap at a time when the blocking member is fixed to the mounting portion as mentioned above.

In this case, the fixing portion is constructed by the step portion which is arranged in the free end portion, the resilient piece portion is arranged in such a manner that a part of the resilient piece portion is in contact with or close to the free end portion of the tab attaching rod, and the engaging and disengaging portion is constructed by the protruding portion which protrudes to the upper surface of the resilient piece portion. Further, the occlusion retaining structure is structured such that a resilient deforming amount of the resilient piece portion is regulated to such a magnitude that the upper end of the protruding portion can move to the height position of the lower end of the step portion. In accordance with this, the fixing portion and the engaging and disengaging portion can be easily provided in the slider in accordance with the invention, and it is possible to stably retain the blocked state of the insertion gap by the occlusion retaining structure at a time when the blocking member is fixed to the mounting portion.

Particularly, in this case, since the mounting portion in accordance with the invention is constructed by the concave groove which is arranged in the upper surface of the upper blade, it is possible to easily and stably mount the blocking member to the mounting portion.

Further, in the invention, the blocking member has a pair of shoulder portions which are arranged while holding the resilient piece portion between them, and the resilient piece portion and the protruding portion are arranged within the region of the shoulder portions at a time of viewing from a side surface side of the blocking member. Note that, the arrangement of the resilient piece portion and the protruding portion within the region of the shoulder portion means a matter that the resilient piece portion and the protruding portion are arranged inside front and rear and up and down end edges of the shoulder portion, and the resilient piece portion and the protruding portion are concealed by the shoulder portion at a time of viewing from the side surface side of the blocking member. In accordance with this, since a pair of shoulder portions are formed so as to protrude to a larger range than the resilient piece portion and the protruding portion, it is possible to protect the resilient piece portion and the protruding portion by the shoulder portion.

Accordingly, for example, even if the other member comes into contact with the blocking member from the external side or the tab comes into contact with the blocking member from the inner side, at a time when the blocking member is fixed to the mounting portion, it is possible to prevent the other member from coming into contact with the resilient piece portion of the blocking member, it is possible to retain a state in which the engaging and disengaging portion of the blocking member is locked to the fixing portion of the tab attaching rod, and it is possible to stably maintain a state in which the blocking member is immovably fixed and the insertion gap is blocked.

Further, in the invention, the concave portion is arranged in the upper surface of the resilient piece portion.

For example, in order to exchange the tab which is attached to the tab attaching rod, there is a case that the blocking member is disconnected from the mounting portion by releasing the state in which the engaging and disengaging portion of the blocking member is locked with the fixing portion of the tab attaching rod. In the case mentioned above, since it is possible to easily press the resilient piece portion by the pressing member in a state in which the rod-like pressing member is inserted to the concave portion, on the basis of the arrangement of the concave portion on the upper surface of the resilient piece portion, it is possible to securely release the locked state between the engaging and disengaging portion and the fixing portion by resiliently deforming the resilient piece portion downward by the pressing member.

On the other hand, in the slider in accordance with the invention, the fixing portion may be constructed by the projection portion which protrudes from the free end portion of the tab attaching rod, the resilient piece portion may be arranged so as to be curved into a S-shape from the main body portion toward the free end portion of the tab attaching rod, and the engaging and disengaging portion may be constructed by the hole portion which is pieced in the leading end portion of the resilient piece portion. Further, the occlusion retaining structure may be structured such that the projection portion is inserted to the hole portion and the leading end portion of the resilient piece portion is fixed to the free end portion, whereby the resilient deformation of the resilient piece portion is regulated. In accordance with this, the fixing portion and the engaging and disengaging portion can be easily provided in the slider in accordance with the invention, and it is possible to stably retain the blocked state of the insertion gap by the occlusion retaining structure at a time when the blocking member is fixed to the mounting portion.

In this case, the mounting portion is constructed by the dovetail groove which is arranged in the upper surface of the upper blade, whereby it is possible to easily and stably mount the blocking member to the mounting portion.

Further, the blocking member has a pair of leg portions which are bifurcated from the main body portion of the blocking member and can resiliently deform in the slider width direction, and the protruding piece portion which protrudes in the direction of being spaced from each other in the leading ends of the leg portions, and the upper surface of the upper blade is provided in a protruding manner with a pair of protruding portions which lock the protruding piece portion of the blocking member which is mounted to the mounting portion. Since the slider has the structure mentioned above, it is possible to further stably fix the blocking member which is mounted to the mounting portion.

Further, in the slider in accordance with the invention, the blocking member has the main body portion which is mounted to the mounting portion, and the blocking portion which is provided in a rising manner on the upper surface of the main body portion and comes into contact with the free end portion of the tab attaching rod at a time of installing and fixing the blocking member. Further, the occlusion retaining structure is constructed by the blocking portion of the blocking member. In accordance with the slider of the invention having the structure mentioned above, the insertion gap can be securely blocked by the blocking portion of the blocking member at a time when the blocking member is fixed to the mounting portion of the slider body, and it is possible to stably retain the blocked state of the insertion gap.

In this case, since the mounting portion is constructed by the dovetail groove which is arranged in the upper surface of the upper blade, it is possible to easily and stably mount the blocking member to the mounting portion.

Further, the blocking member has a pair of leg portions which are bifurcated from the main body portion of the blocking member and can resiliently deform in the slider width direction, and the protruding piece portion which protrudes in the direction of being spaced from each other in the leading ends of the leg portions, and the upper surface of the upper blade is provided in a protruding manner with a pair of protruding portions which lock the protruding piece portion of the blocking member which is mounted to the mounting portion. Since the slider has the structure mentioned above, it is possible to further stably fix the blocking member which is mounted to the mounting portion.

MODE FOR CARRYING OUT THE INVENTION

Preferable embodiments of the invention will be described in detail below with reference to examples and the drawings. Note that, the invention is not limited to each of the embodiments described below, but can be variously changed as long as it has substantially the same structure as the invention and achieves the same operational effect.

For example, since a slider which is described in each of the following embodiments is used in a slide fastener having coil-shaped continuous element rows, a flange is arranged only in an upper blade. However, the invention is not limited to this, but can be applied in the same manner, for example, to a slider which is used in a slide fastener in which a simple element is attached to a fastener tape by an injection molding, and flanges are arranged in both of upper and lower blades.

Embodiment 1

Figure 1:
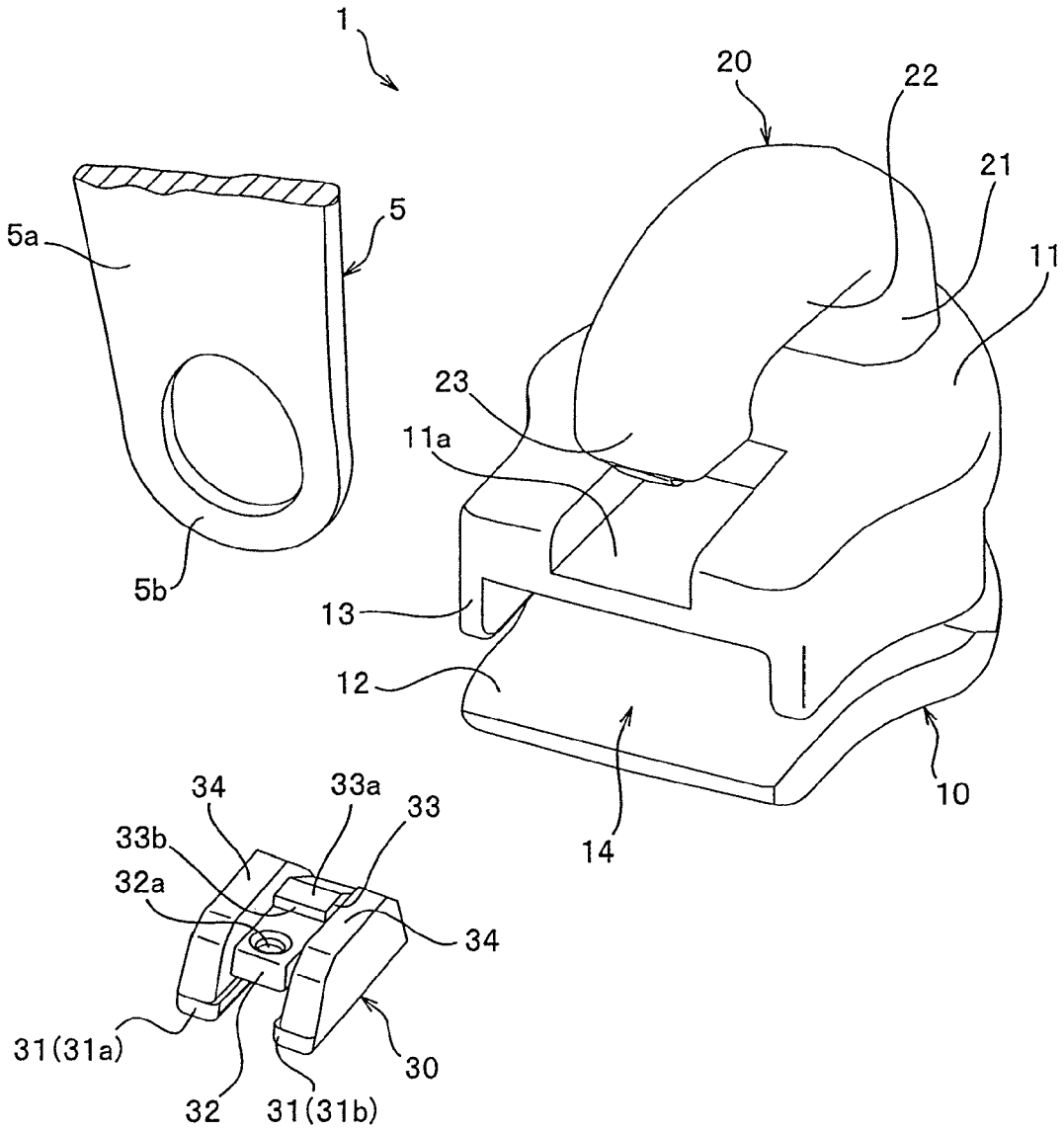
FIG. 1 is an exploded perspective view of a slider for a slide fastener according to embodiment 1 of the invention.
Figure 2:
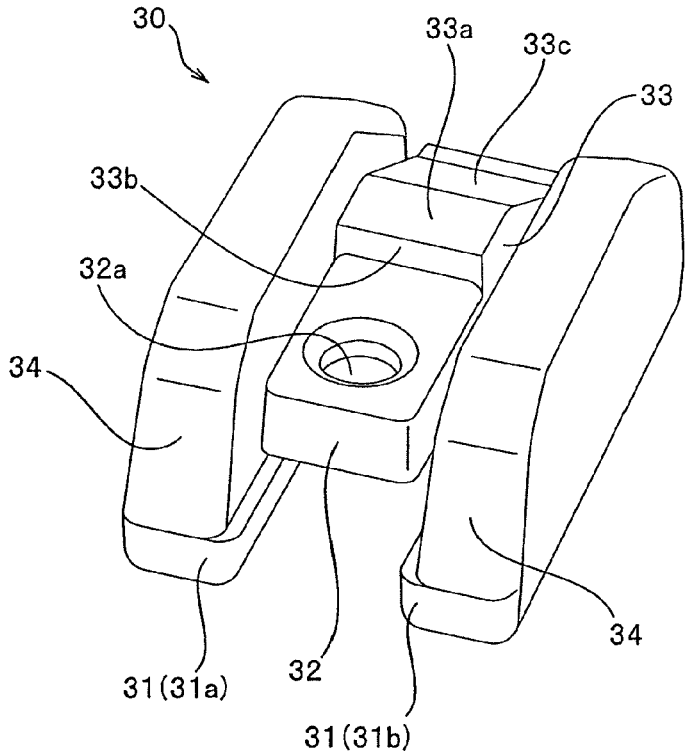
FIG. 2 is a perspective view showing a blocking member in the slider.
Figure 3:
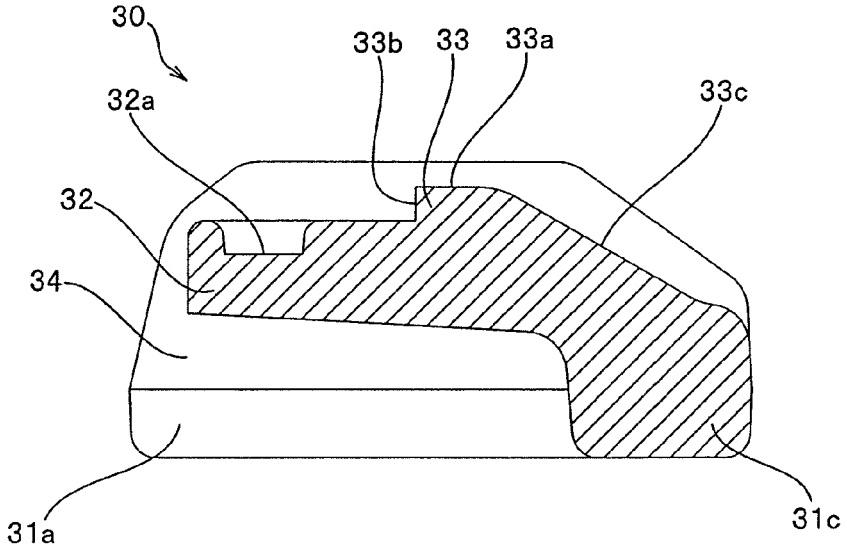
FIG. 3 is a cross-sectional view of the blocking member.
Figure 4:
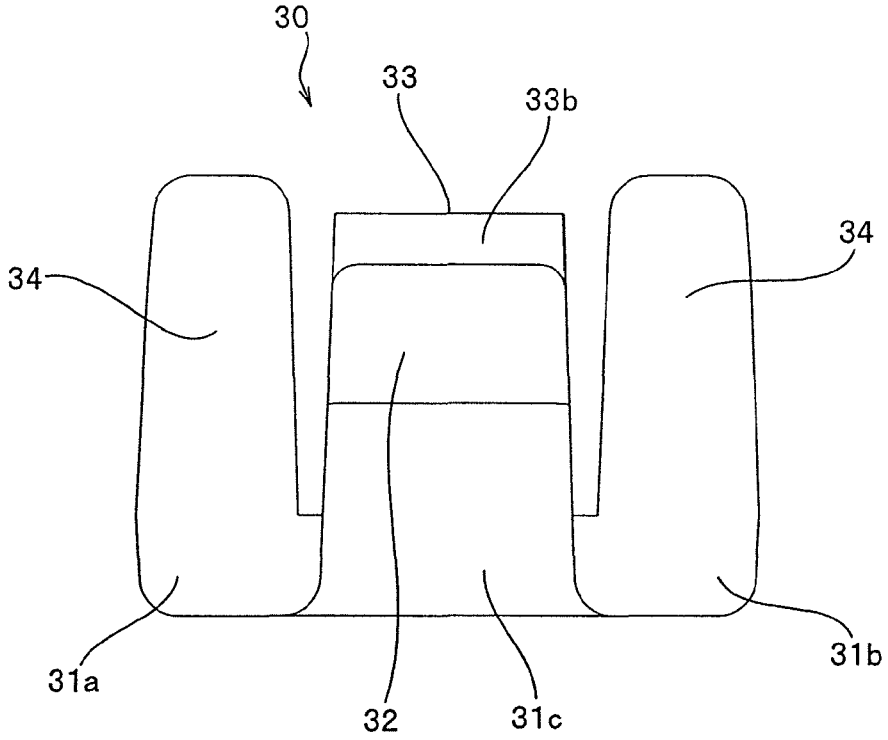
FIG. 4 is a view at a time of viewing the blocking member from a rear side of the slider.
Figure 5:
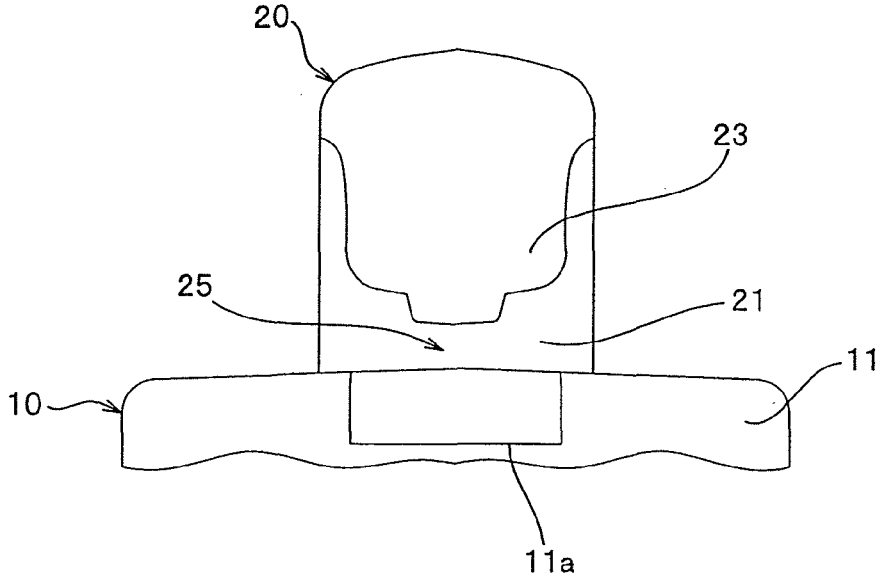
FIG. 5 is a partly enlarged view showing a slider body and a tab attaching rod at a time of viewing the slider from a rear side.
Figure 6:
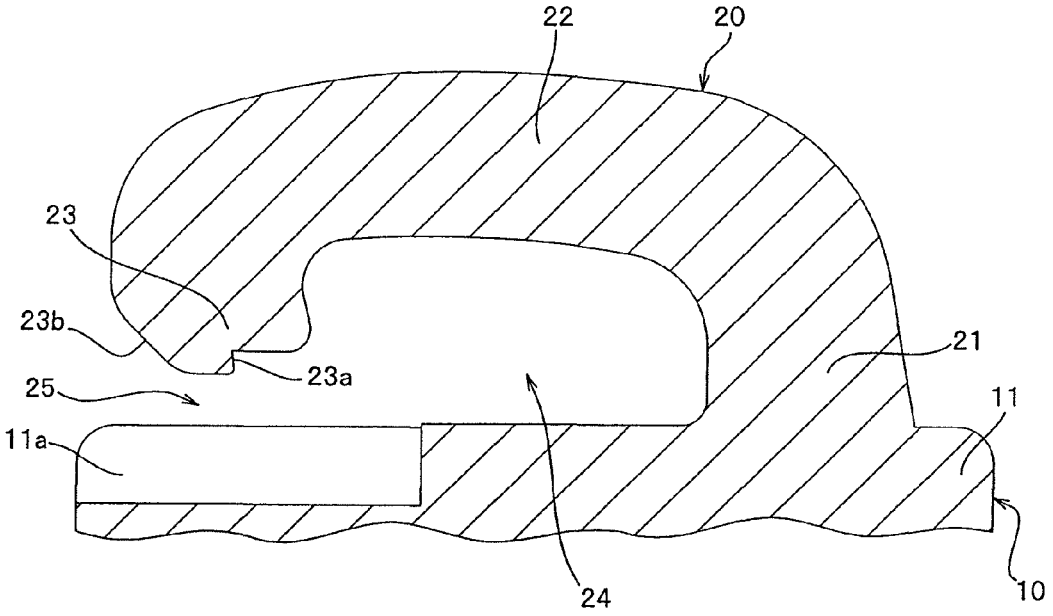
FIG. 6 is a partly cross-sectional view of the slider body and the tab attaching rod.

FIG. 1 is an exploded perspective view of a slider for a slide fastener in accordance with the present embodiment 1, FIGS. 2 to 4 are views showing a blocking member in the slider, and FIGS. 5 and 6 are views showing an upper blade and a tab attaching rod in the slider.

Note that, in the following description, a slider sliding direction is defined as a back and forth direction, and particularly, a direction in which the slider moves for engaging the element rows of the slide fastener is set to a forward direction, and a direction in which it moves for separating the coil-shaped element rows is set to a rearward direction. Further, a height direction of the slider is defined as an up and down direction, and particularly, a direction in a side in which the tab is attached with respect to the slider body is set to an upward direction, and a direction in an opposite side of it is set to a downward direction. Further, a width direction of the slider is defined as a lateral direction.

The slider 1 for the slide fastener in accordance with the present embodiment 1 is structured such that it can engage and separate right and left element rows by sliding along the coil-shaped continuous element rows which are attached to opposed end edges of a pair of right and left fastener stringers (not shown).

Further, as shown in FIG. 1, the slider 1 is provided with a slider body 10, a tab attaching rod 20 which is integrally formed in a cantilevered state in the slider body 10, a blocking member 30 which is mounted to the slider body 10, and a tab 5 which is retained to the tab attaching rod 20. In this case, the tab 5 has a tabular tab main body portion 5*a* which can be pinched by a finger, and an annular attaching shaft portion 5*b* which is integrally formed in one end of the tab main body portion 5*a*.

In the slider 1 in accordance with the present embodiment 1, the slider body 10, the tab attaching rod 20 and the tab 5 are manufactured by die cast molding by using a metal material such as an aluminum alloy, a zinc alloy and the like, and the blocking member 30 is manufactured by injection molding by using a thermoplastic resin material such as a polyamide, a polypropylene, a polyacetal, a polybutylene terephthalate or the like. Note that, in the invention, the material of these members is not particularly limited, but can be optionally changed.

The slider body 10 in the slider 1 has upper and lower blades 11 and 12 which are arranged approximately in parallel to each other, a diamond (not shown) which connects front end portions of the upper and lower blades 11 and 12, and a flange 13 which is provided so as to be hanged in the up and down direction from the right and left side edges of the upper blade 11 toward the lower blade 12.

Right and left shoulder ports are formed in a front portion of the slider body 10 while holding the diamond between them, and a rear port is formed in a rear end of the slider body 10. Further, a Y-shaped element guide path 14 communicating the right and left shoulder ports and the rear port is formed between the upper and lower blades 11 and 12. Further, a concave groove 11*a* to which a blocking member 30 can be mounted is provided in a concave manner in an upper surface side of the upper blade 11 in the slider body 10, from a rear end (an edge end in the rear port side) of the upper blade 11 toward a forward side.

The tab attaching rod 20 which is integrally formed in the slider body 10 has a fixed end portion 21 which rises from the front end portion (a forward side from the center in the back and forth direction of the slider 1) of the upper blade 11, an extension portion 22 which is bent from the fixed end portion 21 so as to extend rearward, and a free end portion 23 which is formed so as to be bent to the upper blade 11 side from the extending portion 22.

Since the tab attaching rod 20 is integrally formed in the slider body 10, it is possible to enhance a strength of the tab attaching rod 20. In accordance with this, the tab attaching rod 20 in accordance with the present embodiment 1 can effectively prevent the tab attaching rod itself from deforming by a tension force of it at a time when the tab 5 is strongly pulled after the tab 5 is attached to the tab attaching rod 20, for example, in comparison with a case that the tab attaching rod is fixed by caulking to the slider body.

Further, in the present embodiment 1, the tab attaching rod 20 is formed as a downward concave shape as a whole at a time of viewing from a side surface side, and an accommodating space 24 which accommodates the attaching shaft portion 5*b* of the tab 5 is formed between a lower end edge in the extension portion 22 of the tab attaching rod 20 and an upper surface of the upper blade 11.

The free end portion 23 of the tab attaching rod 20 is arranged in such a manner that an insertion gap 25 which can insert the attaching shaft portion 5*b* of the tab 5 is formed with respect to the upper surface of the upper blade 11, as shown in FIGS. 5 and 6. Further, a step portion 23*a* is formed in an end surface (a surface facing to the concave groove 11*a* of the upper blade 11) in a side of the free end portion 23 in the tab attaching rod 20, and the step portion 23*a* serves as a fixing portion which engages a protruding portion 33 mentioned later of the blocking member 30 so as to fix the blocking member 30.

Further, a chamfer portion 23*b* is formed in a rear portion of the free end portion 23. In accordance with this, it is possible to easily insert the attaching shaft portion 5*b* of the tab 5 to the insertion gap 25 at a time of introducing the attaching shaft portion 5*b* of the tab 5 into the accommodating space 24 via the insertion gap 25, and it is possible to resiliently deform a resilient piece portion 32 mentioned later of the blocking member 30 easily downward at a time of inserting the blocking member 30 to the concave groove 11*a* of the upper blade 11.

The blocking member 30 in the present embodiment 1 has a main body portion 31 which is inserted to the concave groove 11*a* of the upper blade 11 so as to be mounted, the resilient piece portion 32 which is extended from the main body portion 31 and can resiliently deform in the up and down direction, the protruding portion 33 which is arranged in an upper surface side of the resilient piece portion 32, and a pair of right and left shoulder portions 34 which are arranged in the upper surface of the main body portion 31 in such a manner as to hold the resilient piece portion 32 between them.

The main body portion 31 in the blocking member 30 has left and right side lever portions 31*a* and 31*b*, and a front lever portion 31*c* which connects between front ends of the left and right side lever portions 31*a* and 31*b*, in such a manner as to form an approximately U-shape at a time of viewing from an upper surface. The main body portion 31 is structured such that outer side surfaces in the left and right side lever portions 31*a* and 31*b* (that is, left side surfaces in the left side lever portions 31*a* and 31*b*, and right side surfaces of the right side lever portions 31*a* and 31*b*) come into slidably contact with left and right side wall surfaces of the concave groove 11*a*, at a time of inserting the blocking member 30 into the concave groove 11*a* of the upper blade 11. Further, a dimension in the back and forth direction in the main body portion 31, and a dimension in the back and forth direction in the concave groove 11*a* of the upper blade 11 are set to approximately the same magnitude.

The resilient piece portion 32 in the blocking member 30 is extended toward an upward diagonally rearward direction from a front lever portion 31*c* which is arranged in a front end of the main body portion 31 along a lateral direction, and is arranged in such a manner that approximately the center portion in the back and forth direction in the resilient piece portion 32 comes into contact with (or comes close to) the free end portion 23 of the tab attaching rod 20 at a time when the blocking member 30 is mounted to the concave groove 11*a* of the upper blade 11. Further, a concave portion 32*a* to which a pressing member 7 (refer to FIG. 9) mentioned later can be fitted is arranged in an upper surface of a rear end portion of the resilient piece portion 32.

Further, the resilient piece portion 32 is structured such that a base end portion side connected to the front lever portion 31*c* resiliently deforms in the up and down direction by mainly deflecting. In this case, a resilient deforming amount of the resilient piece portion 32 is regulated to such a magnitude that the upper end surface 33*a* of the protruding portion 33 in the blocking member 30 can move to a height position of a lower end of the step portion 23*a* formed in the tab attaching rod 20, at a time when the blocking member 30 is mounted to the concave groove 11*a* of the upper blade 11.

The protruding portion 33 in the blocking member 30 is provided so as to protrude to an upper surface side of the resilient piece portion 32, as an engaging and disengaging portion which can engage with and disengage from the step portion 23*a* which is arranged in the free end portion 23 of the tab attaching rod 20. In this case, a dimension in a width direction of the resilient piece portion 32 and the protruding portion 33 in the blocking member 30 is set to a dimension which is the same as a dimension in a width direction in the step portion 23*a* (particularly, a lower end surface of the step portion 23*a*) of the tab attaching rod 20.

Further, a rear end surface 33*b* of the protruding portion 33 is formed so as to be orthogonal to the back and forth direction of the slider body 10. Further, the rear end surface 33*b* is arranged at a predetermined position in the back and forth direction corresponding to the step portion 23*a* of the tab attaching rod 20 at a time when the blocking member 30 is mounted to the concave groove 11*a* of the upper blade 11 so as to be fixed as mentioned later. Further, in the present embodiment 1, a forward inclined surface 33*c* which is downward inclined toward a forward side from an upper end of the protruding portion 33 is formed in the resilient piece portion 32 and the protruding portion 33 of the blocking member 30.

A pair of right and left shoulder portions 34 in the blocking member 30 are provided in a rising manner in the left and right side lever portions 31*a* and 31*b* in the main body portion 31 in such a manner as to pinch the resilient piece portion 32 between them. In this case, the front end surfaces of the right and left shoulder portions 34 are arranged on the same plane as the front end surfaces of the main body portion 31 and the resilient piece portion 32. Further, the outer side surfaces of the left and right shoulder portions 34 (that is, the left side surface in the left shoulder portion 34 and the right side surface in the right shoulder portion 34) are arranged respectively on the same planes as the outer side surfaces of the left and right side lever portions 31*a* and 31*b*.

Further, the rear surface, the upper surface and the lower surface of the resilient piece portion 32 are all formed inside the rear surface, the upper surface and the lower surface of the right and left shoulder portions 34, and the shoulder portions 34 are formed so as to protrude upward and rearward than the resilient piece portion 32 and the protruding portion 33 in such a manner that the resilient piece portion 32 and the protruding portion 33 of the blocking member 30 are arranged within a region of the shoulder portion 34 at a time of viewing the blocking member 30 from the side surface side. In accordance with this, it is possible to protect the resilient piece portion 32 and the protruding portion 33 by the right and left shoulder portions 34, and it is possible to make it hard for the attaching shaft portion 5*b* of the tab 5 and the other member to directly come into contact with the resilient piece portion 32 and the protruding portion 33.

Next, a description will be given of a procedure for assembling the slider 1 in accordance with the present embodiment 1.

First of all, a work for making the tab attaching rod 20 of the slider body 10 retain the tab 5 is carried out. Specifically, the attaching shaft portion 5*b* of the tab 5 is introduced into the insertion gap 25 which is arranged between the upper surface of the upper blade 11 and the free end portion 23 of the tab attaching rod 20 from the rear side of the slider body 10. At this time, since the chamfer portion 23*b* is formed in the rear portion of the free end portion 23 as mentioned above, it is possible to smoothly introduce the attaching shaft portion 5*b* of the tab 5 to the insertion gap 25.

Thereafter, the attaching shaft portion 5*b* of the tab 5 is moved to an accommodating space 24 which is formed between the upper surface of the upper blade 11 and the extension portion 22 of the tab attaching rod 20 via the insertion gap 25 so as to be accommodated within the accommodating space 24. In accordance with this, the tab 5 is retained in the tab attaching rod 20 of the slider body 10.

Figure 7:
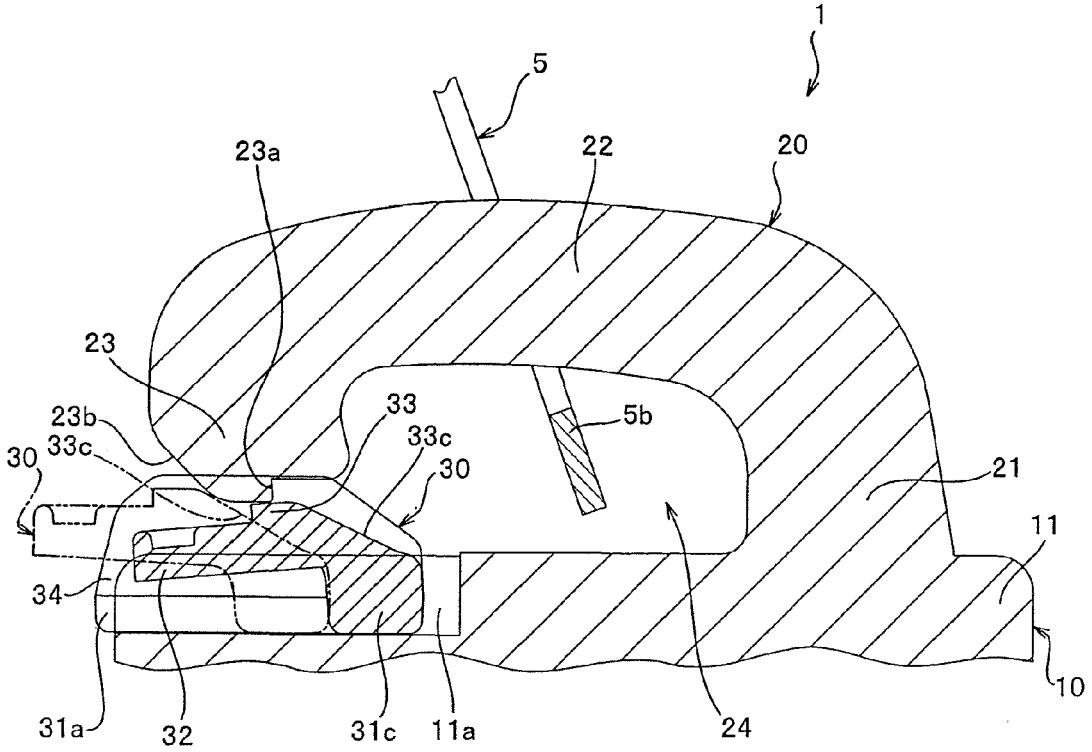
FIG. 7 is a partly cross-sectional view describing an operation for mounting the blocking member to the slider body.

Next, the blocking member 30 is assembled in the slider body 10 to which the tab 5 is retained. In this work, first of all, as shown in FIG. 7, the blocking member 30 is inserted into the concave groove 11*a* from the rear end portion of the slider body 10, in a posture that the front lever portion 31*c* of the blocking member 30 is directed forward. Further, the blocking member 30 is pressed forward while bringing a lower surface (a back surface) of the main body portion 31 in the blocking member 30 into slidably contact with the bottom surface of the concave groove 11*a*, and bringing the outer side surfaces of the main body portion 31 and the shoulder portion 34 in the blocking member 30 into slidably contact with the right and left side wall surfaces of the concave groove 11*a*.

At this time, the forward inclined surface 33*c* of the blocking member 30 comes into contact with the free end portion 23 of the tab attaching rod 20, and the free end portion 23 of the tab attaching rod 20 moves rearward relatively with respect to the blocking member 30 while coming into slidably contact with the forward inclined surface 33*c* of the blocking member 30. In accordance with this, since the blocking member 30 is pressed downward in its protruding portion 33 by the free end portion 23 of the tab attaching rod 20 while moving forward, and the resilient piece portion 32 of the blocking member 30 resiliently deforms downward, it is possible to make the protruding portion 33 of the blocking member 30 get into under the lower side of the free end portion 23 of the tab attaching rod 20.

Figure 8:
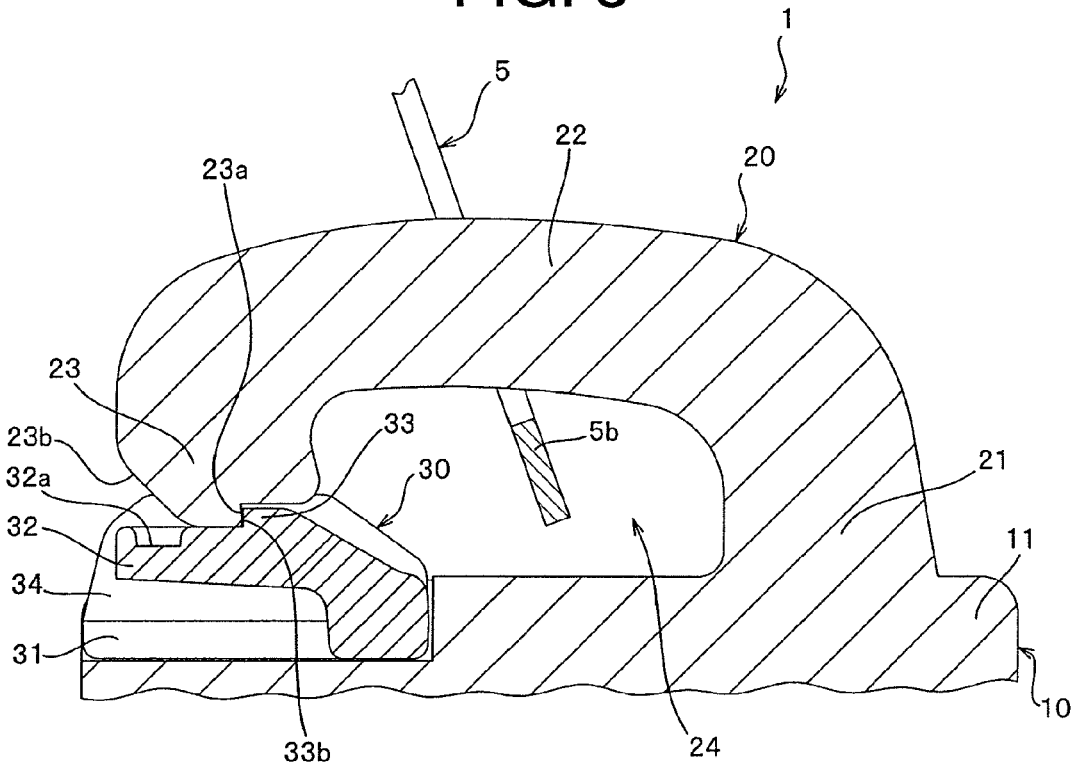
FIG. 8 is a partly cross-sectional view showing a state in which the blocking member is mounted to the slider body so as to be fixed.

Further, when the blocking member 30 further moves forward, and the rear end surface 33*b* of the protruding portion 33 reaches the position of the step portion 23*a* which is formed in the free end portion 23 of the tab attaching rod 20, the pressing of the protruding portion 33 by the free end portion 23 is released, and the resilient piece portion 32 is resiliently returned to the original position. In accordance with this, as shown in FIG. 8, the protruding portion 33 of the blocking member 30 enters into a space which is formed in the forward side of the step portion 23*a*, and the protruding portion 33 is locked with the step-portion 23*a* of the free end portion 23.

Since the protruding portion 33 of the blocking member 30 is locked with the free end portion 23 of the tab attaching rod 20 as mentioned above, the blocking member 30 is mounted to the slider body 10 so as to be immovably fixed. In accordance with this, the insertion gap 25 which is formed in the slider body 10 comes to a state in which it is blocked by the blocking member 30, and the attachment of the tab 5 to the slider body 10 is completed.

The slider 1 in accordance with the present embodiment 1 can be easily assembled by afterward attaching the tab 5 to the slider body 10 in which the tab attaching rod 20 is integrally formed, by carrying out the work as mentioned above. Accordingly, for example, in a manufacturer side of the clothes or the bags, it is possible to freely attach the tab 5 having a desired design to the slider body 10, and it is possible to widely expand the width of the design of the clothes or the bags.

Further, in the slider 1 in accordance with the present embodiment 1 which is assembled as mentioned above, the protruding portion 33 of the blocking member 30 fixed to the slider body 10 is locked with the free end portion 23 of the tab attaching rod 20, and the blocking member 30 is immovably fixed. Further, a resilient deforming amount of the resilient piece portion 32 in the blocking member 30 is regulated to such a magnitude that the upper end surface 33*a* of the protruding portion 33 can move to a height position of the lower end of the step portion 23*a* of the tab attaching rod 20, as mentioned above.

In accordance with this, when the blocking member 30 is fixed to the slider body 10, it is possible to stably retain a state in which the insertion gap 25 between the upper surface of the upper blade 11 and the free end portion 23 of the tab attaching rod 20 is blocked by the blocking member 30. In accordance with this, it is possible to securely prevent the other member such as the thin patching which accidentally exists in the peripheral portion of the slider from intruding into the insertion gap 25 so as to be pinched.

Particularly, in the slider 1 in accordance with the present embodiment 1, a pair of right and left shoulder portions 34 in the blocking member 30 are arranged in such a manner as to pinch the resilient piece portion 32 between them, and protrude upward and rearward than the resilient piece portion 32 and the protruding portion 33. In accordance with this, since it is possible to protect the resilient piece portion 32 and the protruding portion 33 by the right and left shoulder portions 34, it is possible to inhibit the other member such as the thin patching from directly coming into contact with the resilient piece portion 32 of the blocking member 30 from the external side, and inhibit the attaching shaft portion 5*b* of the tab 5 from directly coming into contact with the resilient piece portion 32 and the protruding portion 33 of the blocking member 30 from the inner side. Accordingly, it is possible to more stably retain the state in which the protruding portion 33 of the blocking member 30 is locked with the free end portion 23 of the tab attaching rod 20, and it is possible to stably maintain the immovable state of the blocking member 30 which is fixed to the slider body 10.

Accordingly, it is possible to effectively prevent the problem caused by the other member being pinched into the slider 1, for example, in the case that the slide fastener is constructed by using the slider 1 in accordance with the present embodiment 1, and the slide fastener is attached to the product of the clothes or the bags so as to be used, for example, the problem that the clothes or the bags are pulled by the other member, and the sliding operation of the slider 1 is obstructed by the other member.

Figure 9:
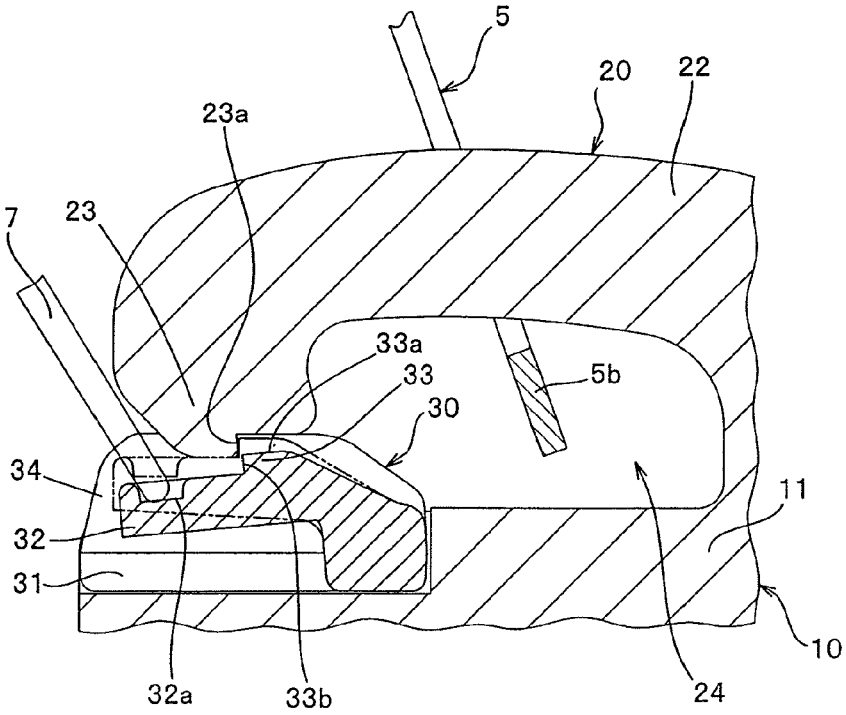
FIG. 9 is a partly cross-sectional view describing an operation for disconnecting the blocking member from the slider body.

Note that, in the slider 1 in accordance with the present embodiment 1, in the case of detaching the tab 5 which is once attached to the tab attaching rod 20, a rod-like pressing member 7 for pressing the resilient piece portion 32 of the blocking member 30 is prepared, and one end of the pressing member 7 is fitted into the concave portion 32*a* which is formed in a rear end portion of the resilient piece portion 32, as shown in FIG. 9. Further, the protruding portion 33 of the blocking member 30 is detached from the free end portion 23 of the tab attaching rod 20 so as to release the locked state between the protruding portion 33 and the free end portion 23, by pressing the resilient piece portion 32 downward by the pressing member 7 so as to resiliently deform the resilient piece portion 32.

Further, since the protruding portion 33 of the blocking member 30 gets into under the free end portion 23 of the tab attaching rod 20 by drawing out the blocking member 30 rearward while pressing the resilient piece portion 32 by the pressing member 7, it is possible to easily detach the blocking member 30 from the concave groove 11*a* of the slider body 10, and it is possible to make the insertion gap 25 which is arranged between the upper surface of the upper blade 11 and the free end portion 23 of the tab attaching rod 20 open. Thereafter, the tab 5 can be easily detached by drawing out the attaching shaft portion 5*b* of the tab 5 from the accommodating space 24 via the opened insertion gap 25.

Embodiment 2

Figure 10:
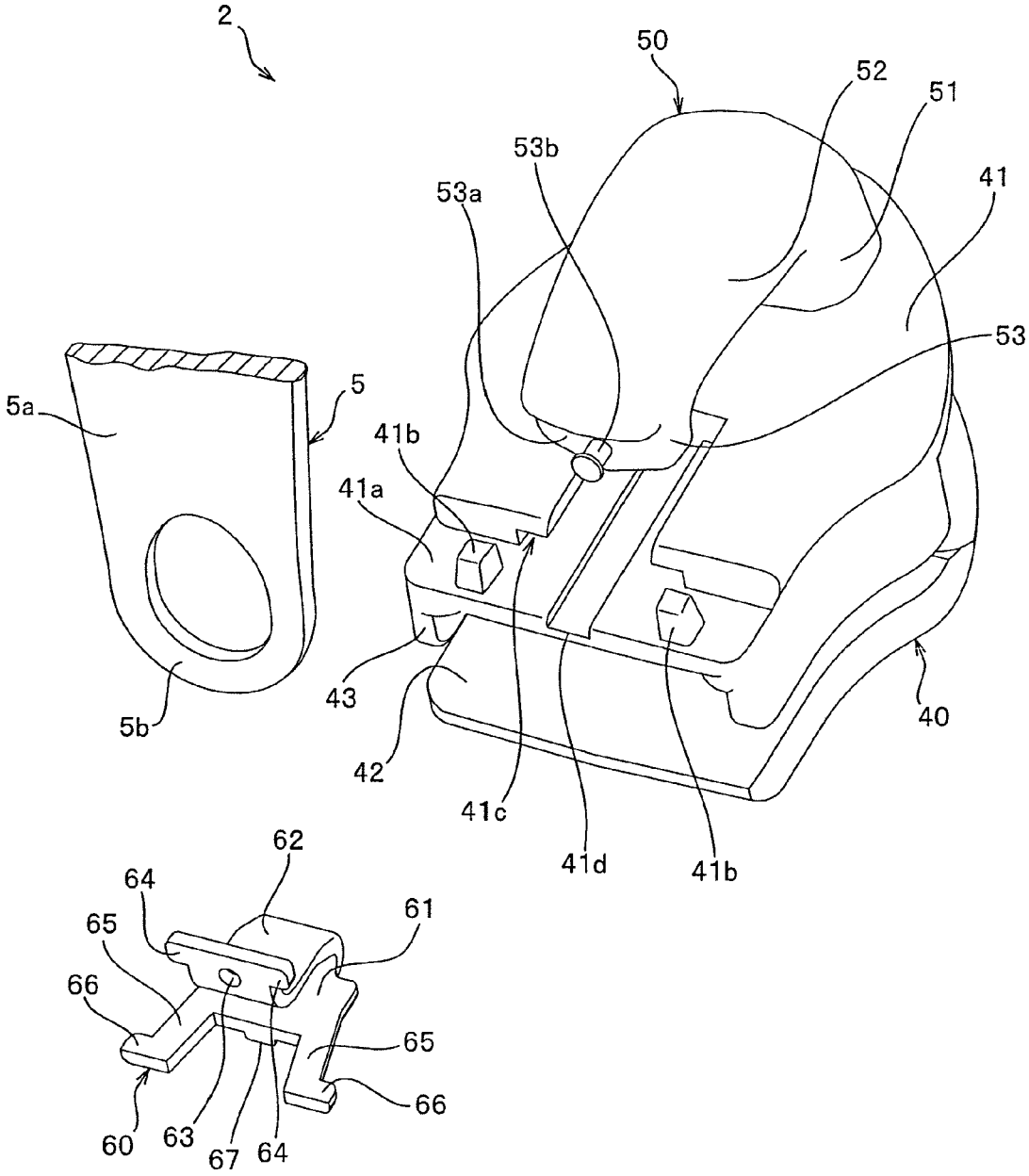
FIG. 10 is an exploded perspective view of a slider for a slide fastener according to embodiment 2 of the invention.
Figure 11:
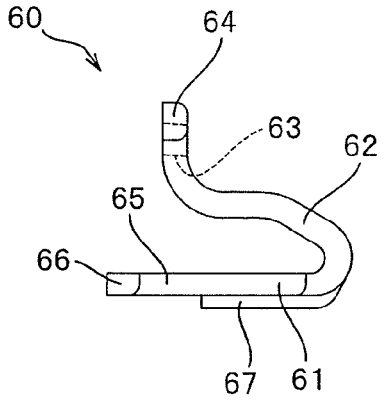
FIG. 11 is a side view showing a blocking member in the slider.
Figure 12:
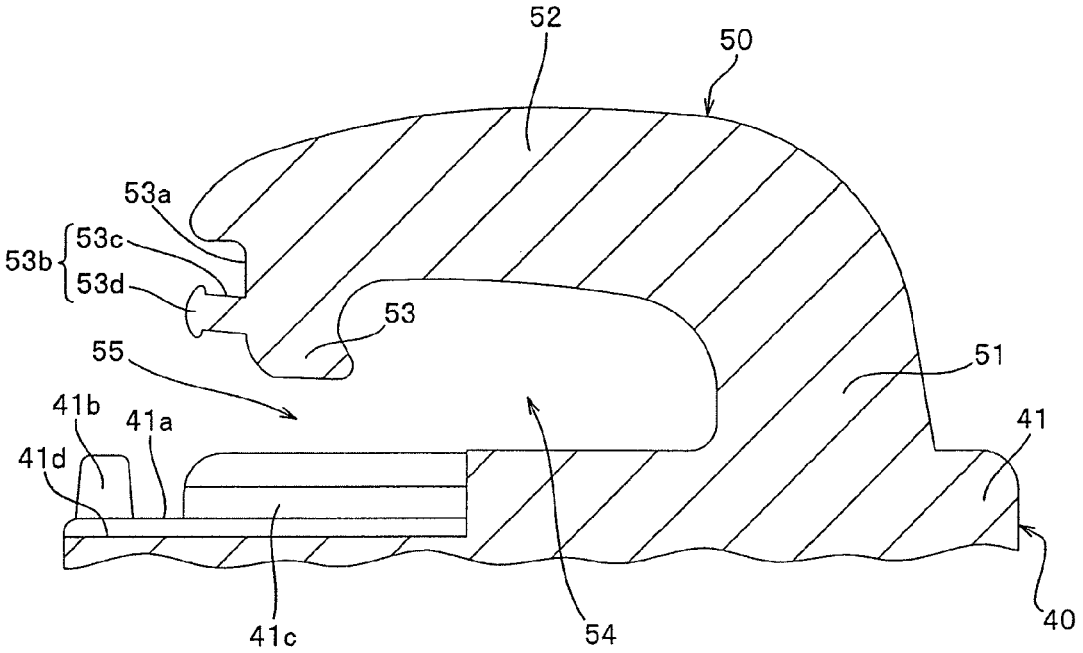
FIG. 12 is a partly cross-sectional view of a slider body and a tab attaching rod in the slider.

FIG. 10 is an exploded perspective view of a slider for a slide fastener in accordance with the present embodiment 2. Further, FIG. 11 is a side view showing a blocking member in the slider, and FIG. 12 is a partly cross-sectional view of a slider body and a tab attaching rod in the slider.

Note that, in the sliders in accordance with the present embodiment 2 and embodiment 3 mentioned later, descriptions of elements having the same structures as the members or the positions which are described in the embodiment 1 mentioned above will not be repeated by expressing with the same reference numerals.

A slider 2 for a slide fastener in accordance with the present embodiment 2 is provided with a slider body 40, a tab attaching rod 50 which is integrally formed in a cantilevered state in the slide body 40, a blocking member 60 which is mounted to the slide body 40, and a tab 5 which is retained to the tab attaching rod 50.

The slider body 40 in the slider 2 has upper and lower blades 41 and 42 which are arranged approximately in parallel to each other, a diamond (not shown) which connects front end portions of the upper and lower blades 41 and 42, and a flange 43 which is provided so as to be hanged in an up and down direction from right and left side edges of the upper blade 41 toward the lower blade 42.

A step portion 41*a* is provided in an upper surface side of a rear end portion of the upper blade 41 in the slider body 40, and the step portion 41*a* is provided with a pair of right and left protruding portions 41*b* in a protruding manner. Further, in a center portion in a lateral direction of the upper blade 41, a dovetail groove 41*c* which can mount a blocking member 60 is formed from the step portion 41*a* toward a forward side. Further, in a portion in which the step portion 41*a* and the dovetail groove 41*c* of the upper blade 41 are arranged, a guide groove 41*d* to which a guide portion 67 mentioned later of the blocking member 60 is fitted is provided so as to be concaved from the rear end of the upper blade 41 toward the forward side.

The tab attaching rod 50 which is integrally formed in the upper blade 41 of the slider body 40 has a fixed end portion 51 which rises from a front end portion of the upper blade 41, an extension portion 52 which is bent from the fixed end portion 51 so as to extend rearward, and a free end portion 53 which is formed by being bent from the extension portion 52 to the upper blade 41 side. Further, an accommodating space 54 which accommodates the attaching shaft portion 5*b* of the tab 5 is formed between a lower end edge in the extension portion 52 of the tab attaching rod 50 and an upper surface of the upper blade 41.

The free end portion 53 of the tab attaching rod 50 is arranged in such a manner that an insertion gap 55 which can insert the attaching shaft portion 5*b* of the tab 5 with respect to the upper surface of the upper blade 41, as shown in FIG. 12. Further, a notch portion 53*a* is provided in a rear end in a side of the free end portion 53 in the tab attaching rod 50, and a projection portion 53*b* protruding toward a rear side is arranged as a fixing portion of the blocking member 60 in the notch portion 53*a*. In this case, the projection portion 53*b* has a post portion 53*c* which protrudes out of the free end portion 53 and has a columnar shape, and an locking head portion 53*d* which is arranged in such a manner as to bulge to a leading end of the post portion 53*c*.

The blocking member 60 in the present embodiment 2 has a main body portion 61 which is fitted to the dovetail groove 41*c* of the upper blade 41 so as to be mounted, a resilient piece portion 62 which is extended upward from a front end of the main body portion 61, a hole portion 63 which is provided in a piercing manner in a leading end portion of the resilient piece portion 62, a lug portion 64 which is extended in a lateral direction from a leading end portion of the resilient piece portion 62, a pair of right and left leg portions 65 which are bifurcated toward a rear side from the main body portion 61 so as to be extended, protruding piece portions 66 which protrude in a mutually spaced direction in leading ends of the respective leg portions 65, and a guide portion 67 which is provided in a hanged manner on a lower surface (a back surface) of the main body portion 61.

The main body portion 61 in the blocking member 60 is formed as a tabular shape in such a manner as to be fitted to the dovetail groove 41*c* which is arranged in the upper blade 41. The resilient piece portion 62 in the blocking member 60 is curved approximately into an S-shape, and is formed in such a manner as to be resiliently deformable in an up and down direction. A magnitude of a diameter of the hole portion 63 which is formed in the resilient piece portion 62 is set to be larger than a diameter of the post portion 53*c* in the projection portion 53*b*, and be smaller than a largest diameter of the locking head portion 53*d*.

Further, the right and left lug portions 64 in the blocking member 60 are provided for making it easy for the leading end portion of the resilient piece portion 62 to be pinched by the finger. A pair of right and left leg portions 65 in the blocking member 60 are arranged so as to be inclined in the back and forth direction in such a manner that a distance between the leg portions 65 is increased little by little toward the leading end, and are formed so as to be resiliently deformable in a lateral direction (a slider width direction). Further, in this case, in order to make it easy for the right and left leg portions 65 to be resiliently deformed toward the inner side, a slit having a predetermined magnitude can be formed in an inner side of a base end portion in a side of the main body portion 61 in the leg portion 65.

The protruding piece portion 66 in the blocking member 60 is formed at such a magnitude that it can be fitted to a region of the step portion 41*a* in a forward side than the projection portion 53*b* which is provided in a protruding manner in the upper blade 41. Further, the protruding piece portion 66 is structured such as to be locked with the protruding portion 41*b* of the upper blade 41 at a time of being fitted to the region of the step portion 41*a*. A guide portion 67 in the blocking member 60 is formed along the back and forth direction, and a width of the guide portion 67 is set in correspondence to a magnitude of the groove width of the guide groove 41*d* which is provided in a concave manner in the upper blade 41.

Figure 13:
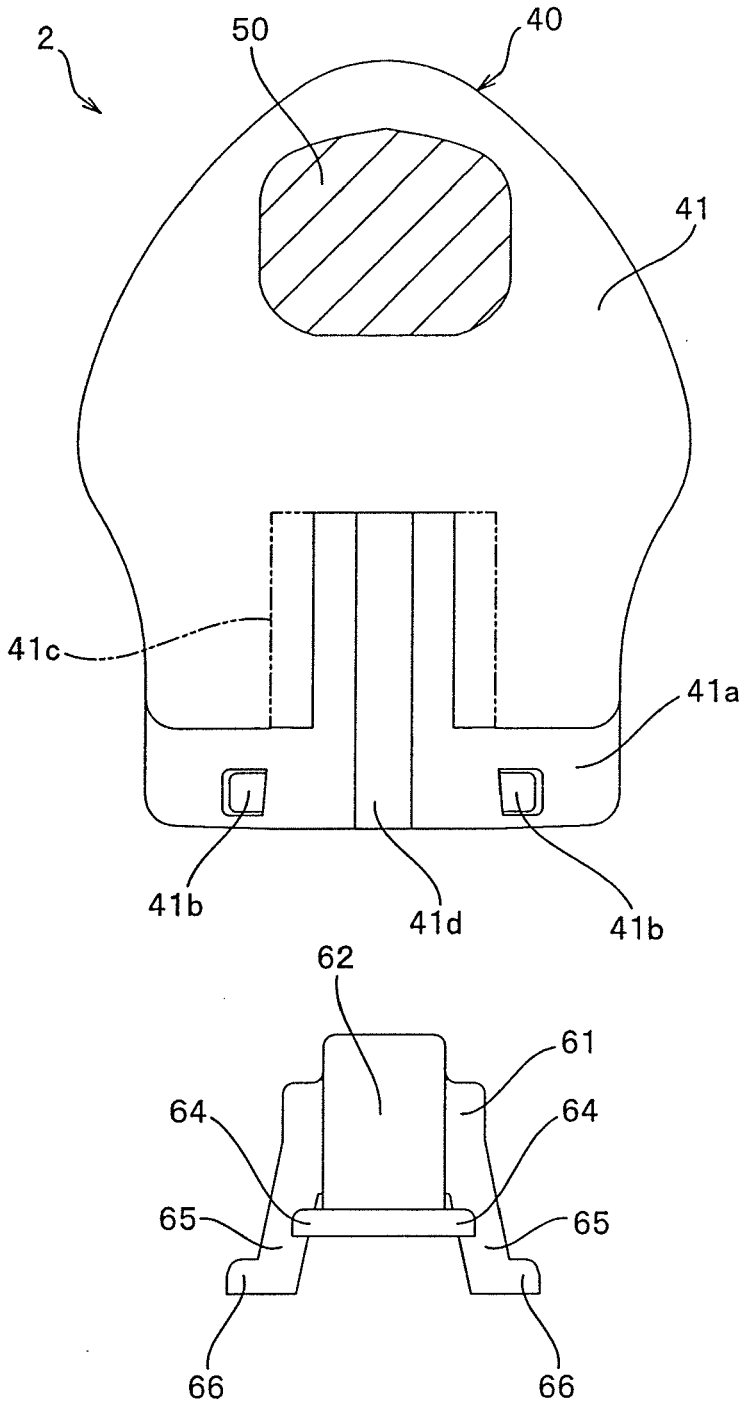
FIG. 13 is a schematic view showing a state before the blocking member is mounted to the slider body.

In the case of assembling the slider 2 in accordance with the present embodiment 2 having the structure mentioned above, first of all, the blocking member 60 is mounted to the slider body 40 so as to be temporarily fixed. Specifically, as shown in FIG. 13, the blocking member 60 is inserted toward the dovetail groove 41*c* of the upper blade 41 from a rearward side of the slider body 40, and the main body portion 61 of the blocking member 60 is fitted to the dovetail groove 41*c*. At this time, it is possible to easily carry out a positioning of the blocking member 60 with respect to the slider body 40, by fitting the guide portion 67 of the blocking member 60 to the guide groove 41*d* of the upper blade 41.

Figure 14:
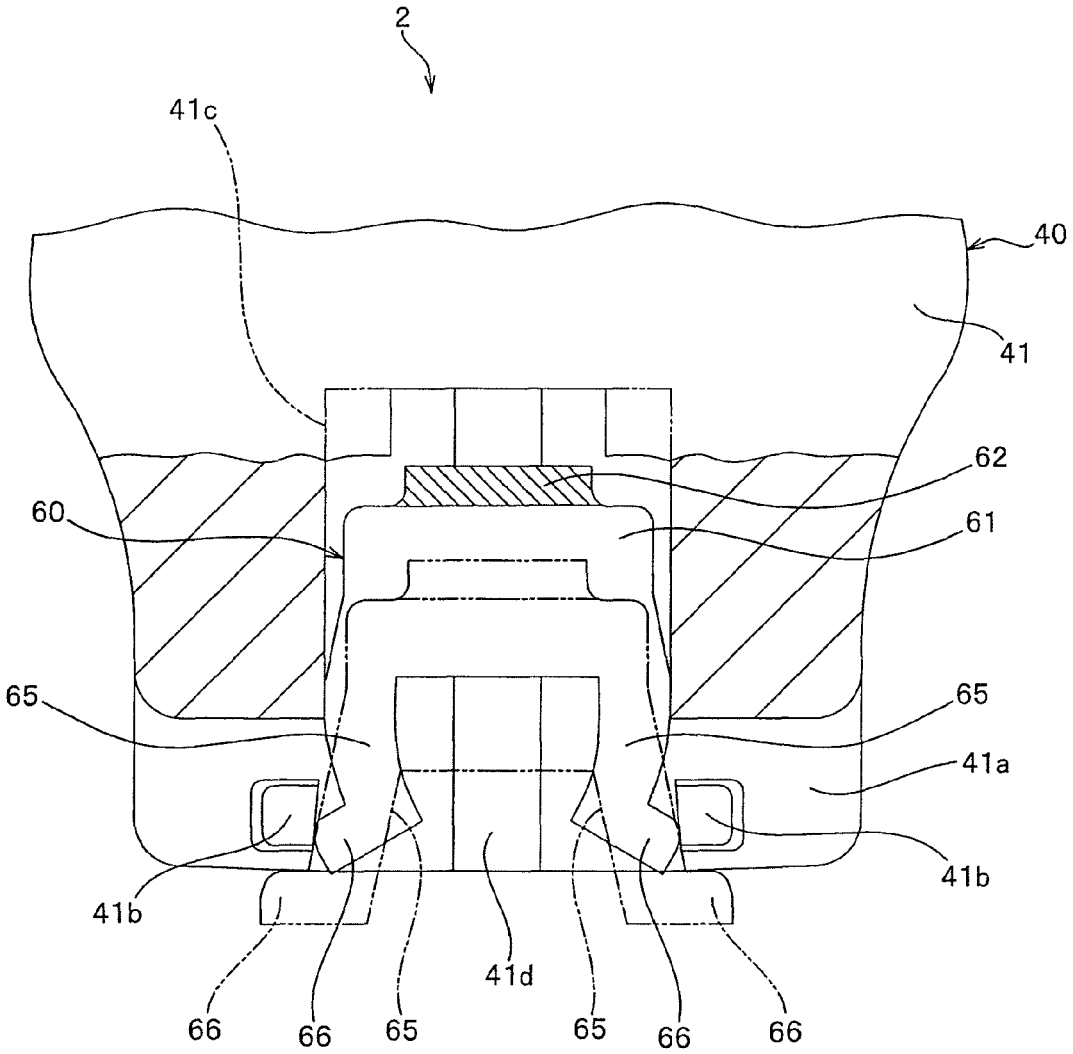
FIG. 14 is a schematic view describing an operation for mounting the blocking member to the slider body.

Further, the blocking member 60 is pressed toward the forward side while pressing the right and left protruding piece portions 66 of the blocking member 60 toward the inner side so as to resiliently deform the right and left leg portions 65 in the slide width direction, as shown in FIG. 14, after the main body portion 61 of the blocking member 60 is fitted to the dovetail groove 41*c* and the right and left leg portions 65 or the right and left protruding piece portions 66 in the blocking member 60 come into contact with the protruding portion 41*b* of the upper blade 41.

Figure 15:
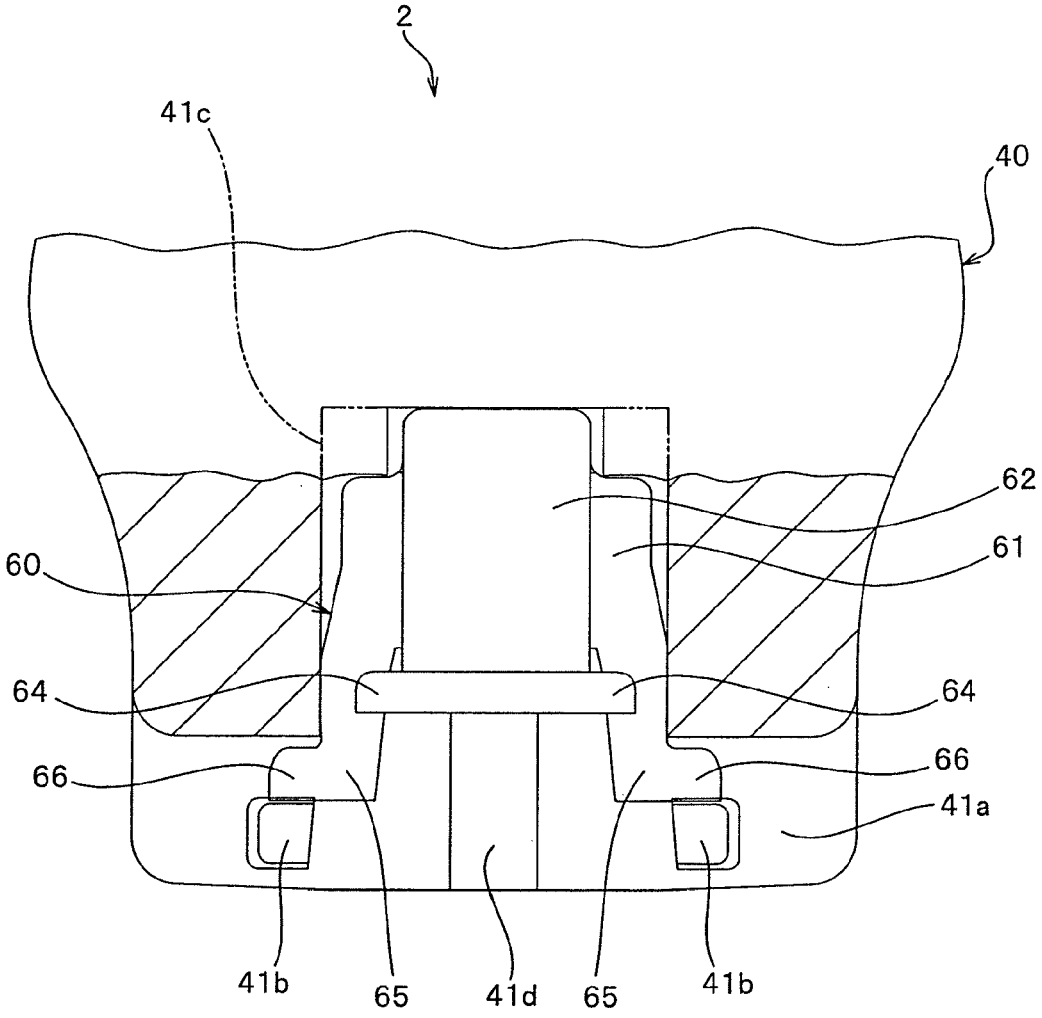
FIG. 15 is a schematic view showing a state in which the blocking member is mounted to the slider body.

In accordance with this, as shown in FIG. 15, the blocking member 60 is fitted into the dovetail groove 41*c* until the front end of the resilient piece portion 62 comes into contact with the front end surface of the dovetail groove 41*c*, and the protruding piece portion 66 of the blocking member 60 is locked with the protruding portion 41*b* of the upper blade 41, whereby it is possible to temporarily fix the blocking member 60 to the upper blade 41 of the slider body 40.

Figure 16:
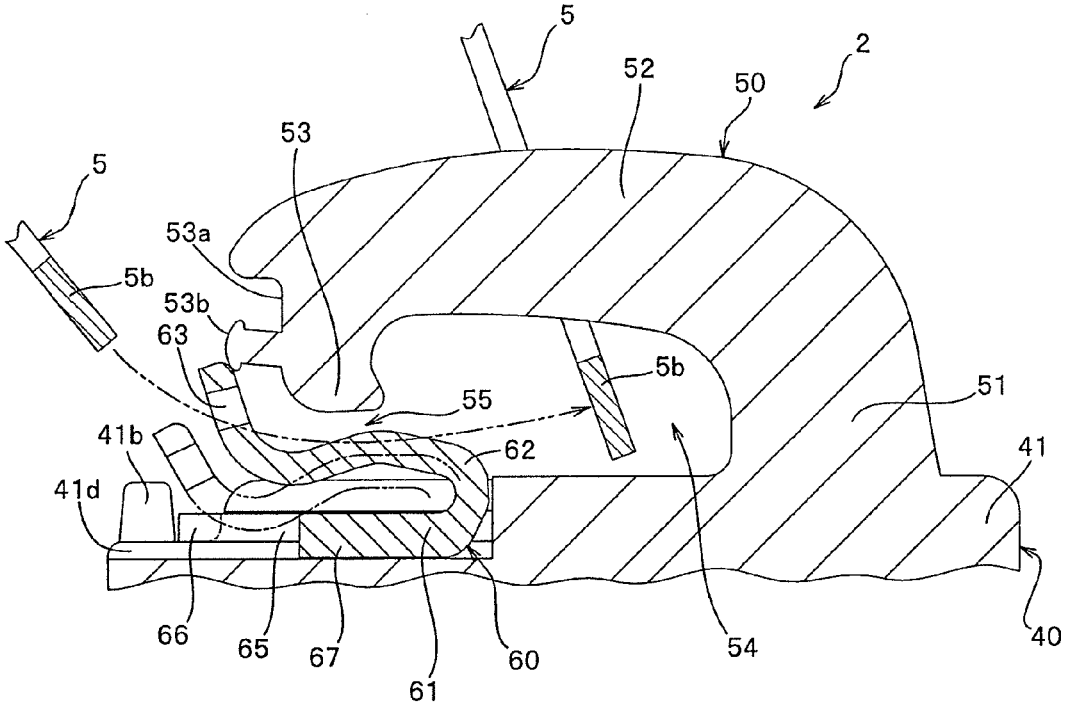
FIG. 16 is a partly cross-sectional view describing an operation for attaching a tab to a tab attaching rod after the blocking member is mounted to the slider body.

Subsequently, the tab 5 will be retained to the tab attaching rod 50 of the slider body 40 to which the blocking member 60 is temporarily fixed. In this work, as shown in FIG. 16, the resilient piece portion 62 is resiliently deformed by pressing downward the resilient piece portion 62 of the blocking member 60 which is temporarily fixed to the slider body 40.

In accordance with this, the insertion gap 55 to which the attaching shaft portion 5*b* of the tab 5 can be inserted is open between the upper surface of the upper blade 41 and the free end portion 53 of the tab attaching rod 50. Further, the tab 5 is retained to the tab attaching rod 50 of the slider body 40 by introducing the attaching shaft portion 5*b* of the tab 5 into the accommodating space 54 from the rear side of the slider body 40 via the insertion gap 55, in a state in which the insertion gap 55 is open.

The leading end portion of the resilient piece portion 62 is moved close from the rear side of the free end portion 53 of the tab attaching rod 50 by resiliently restoring the resilient piece portion 62 of the blocking member 60 to the original state, after the tab 5 is retained to the tab attaching rod 50. Further, the projection portion 53*b* which is formed in the free end portion 53 of the tab attaching rod 50 is fitted into the hole portion 63 which is formed in the leading end portion of the resilient piece portion 62.

Figure 17:
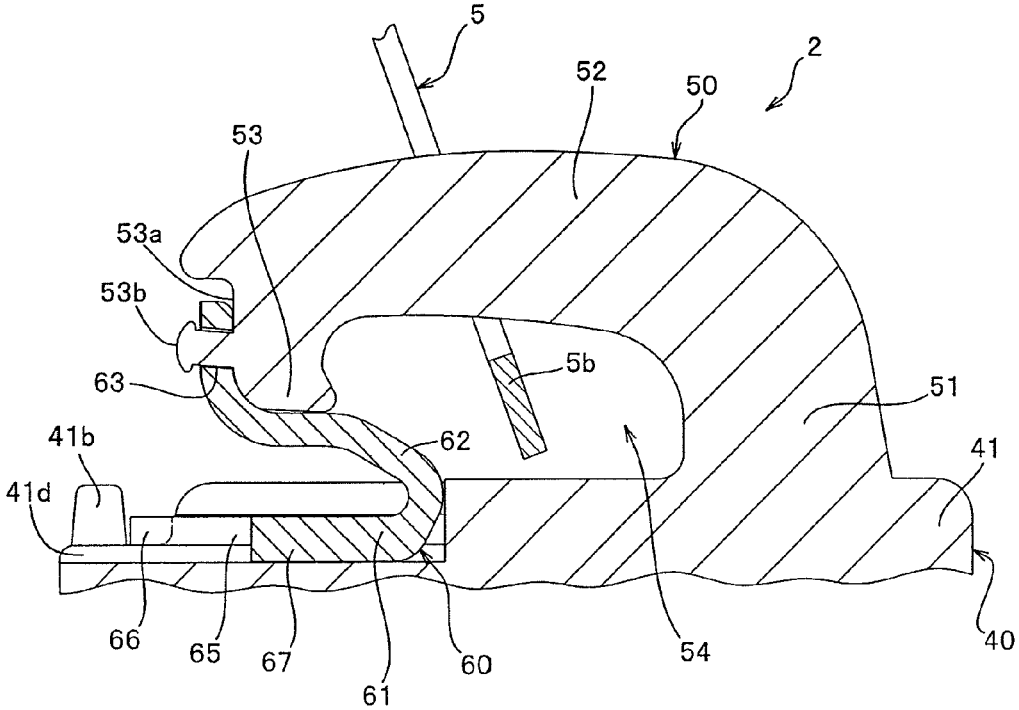
FIG. 17 is a partly cross-sectional view showing a state in which the tab is attached to the tab attaching rod.

In accordance with this, as shown in FIG. 17, since the leading end portion of the resilient piece portion 62 is fixed to the free end portion 53 of the tab attaching rod 50, the blocking member 60 is immovably fixed to the slider body 40, and the insertion gap 55 comes to a state of being blocked by the blocking member 60. In accordance with this, the attachment of the tab 5 to the slider body 40 is completed.

At this time, since the main body portion 61 of the blocking member 60 is fitted to the dovetail groove 41*c* of the upper blade 41, and the leading end portion of the resilient piece portion 62 is fixed to the free end portion 53 of the tab attaching rod 50, a resilient deformation in the up and down direction of the resilient piece portion 62 in the blocking member 60 is regulated. In accordance with this, it is possible to stably retain the state in which the insertion gap 55 is blocked by the blocking member 60.

As mentioned above, in the slider 2 in accordance with the present embodiment 2, it is possible to easily attach the tab 5 afterward to the slider body 40. Particularly, in the slider 2 in accordance with the present embodiment 2, it is possible to carry out the attachment of the tab 5 after the blocking member 60 is temporarily fixed to the slider body 40.

Accordingly, it is possible to freely attach the tab 5 having a desired design to the slider body 40, in the manufacturer of the clothes or the bags, for example, by delivering the slider in the state in which the blocking member 60 is temporarily fixed to the slider body 40, to the manufacturer of the clothes or the bags. Further, since the blocking member 60 is temporarily fixed to the slider body 40, it is possible to prevent a loss of the blocking member 60 to be mounted to the slider body 40, and it is possible to easily carry out a parts management of the slider body 40 and the blocking member 60.

Further, in the slider 2 in accordance with the present embodiment 2, since the leading end portion of the resilient piece portion 62 in the blocking member 60 is fixed to the free end portion 53 of the tab attaching rod 50, the resilient deformation in the up and down direction of the resilient piece portion 62 can be regulated, and it is possible to stably retain the blocked state of the insertion gap 55. In accordance with this, it is possible to securely prevent the other member such as the thin patching from being inserted to the insertion gap 55 so as to be pinched.

Accordingly, for example, in the case that the slide fastener is constructed by using the slider 2 in accordance with the present embodiment 2, and the slide fastener is attached to the product of the clothes or the bags so as to be used, it is possible to effectively prevent the conventional problem caused by the pinching of the other member to the slider 2.

In this case, in the slider 2 in accordance with the present embodiment 2, in the case of detaching the tab 5 which is once attached to the tab attaching rod 50, the leading end portion of the resilient piece portion 62 which is fixed to the free end portion 53 of the tab attaching rod 50 is drawn to the rear side, and the projection portion 53*b* which is formed in the free end portion 53 of the tab attaching rod 50 is detached from the hole portion 63 which is formed in the leading end portion of the resilient piece portion 62. In accordance with this, the state in which the resilient piece portion 62 is locked with the free end portion 53 of the tab attaching rod 50 is released.

Thereafter, the insertion gap 55 is made open by pressing the resilient piece portion 62 of the blocking member 60 downward so as to resiliently deform the resilient piece portion 62. Further, it is possible to easily detach the tab 5 by drawing out the attaching shaft portion 5*b* of the tab 5 from the accommodating space 54 via the opened insertion gap 55.

Embodiment 3

Figure 18:
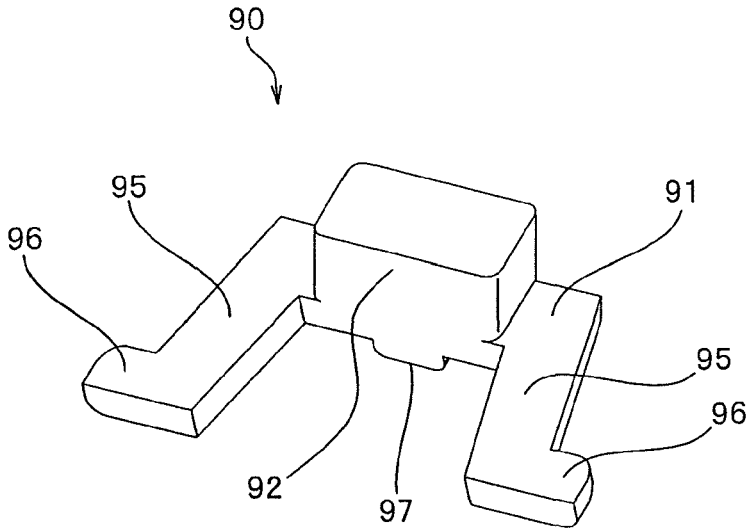
FIG. 18 is a perspective view showing a blocking member in a slider for a slide fastener according to embodiment 3 of the invention.
Figure 19:
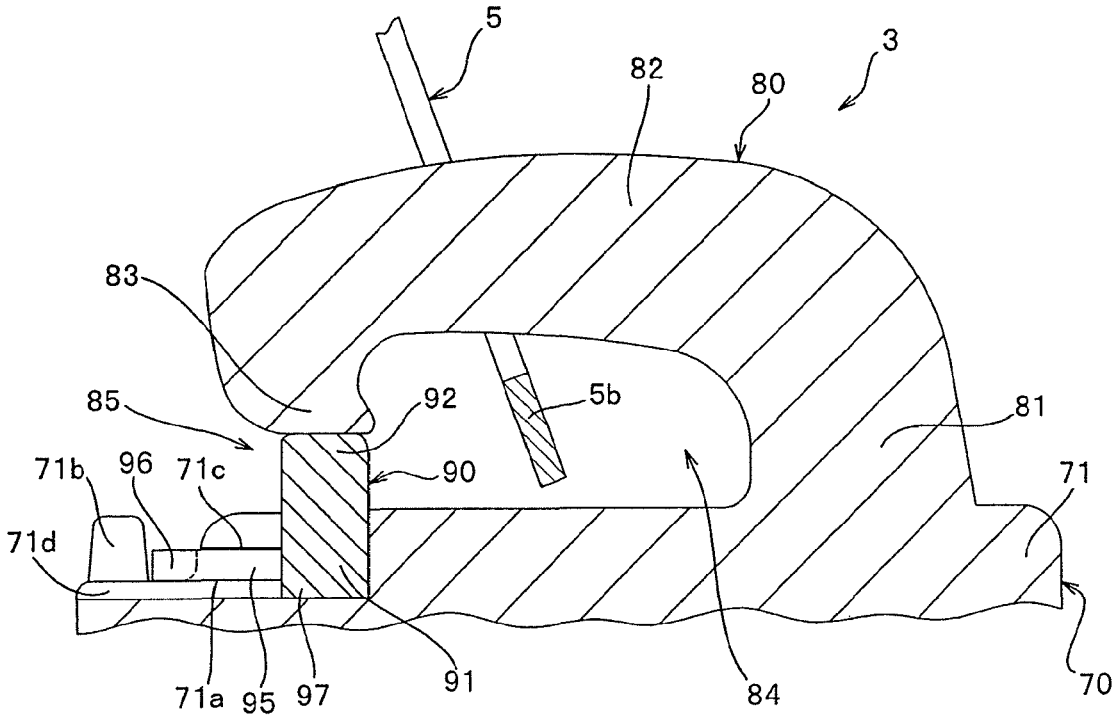
FIG. 19 is a partly cross-sectional view showing a state in which a tab is attached to a tab attaching rod, and the blocking member is mounted to a slider body so as to be fixed.
Figure 20:
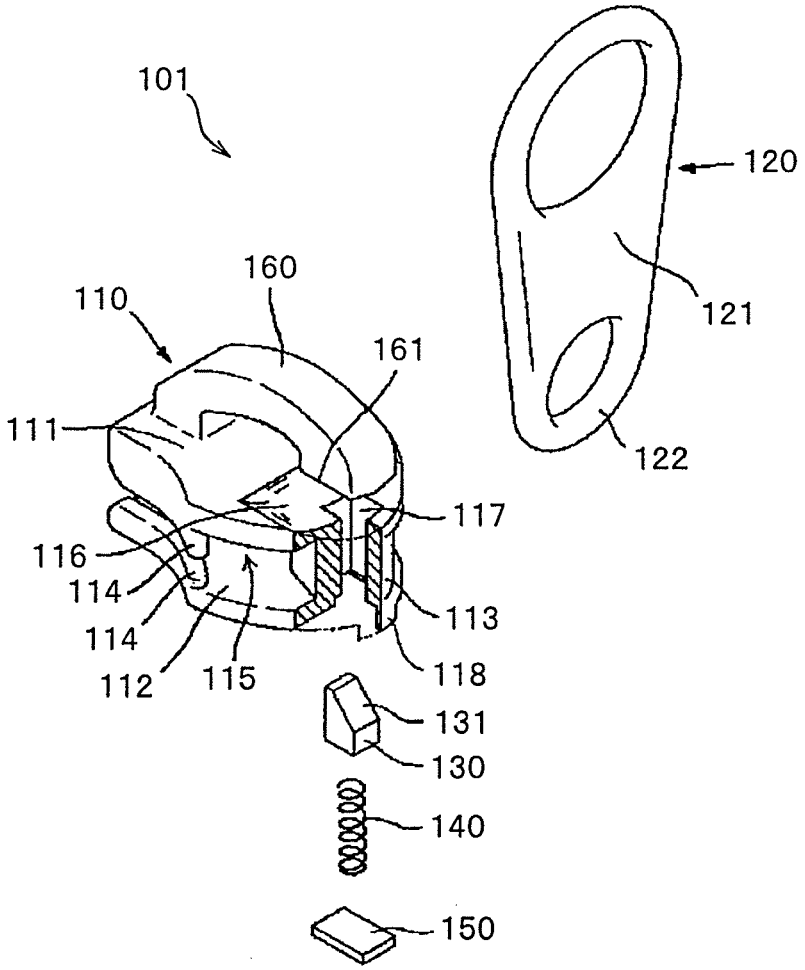
FIG. 20 is an exploded perspective view of a conventional slider.

FIG. 18 is a perspective view showing a blocking member in a slider for a slide fastener in accordance with the present embodiment 3, and FIG. 19 is a partly cross-sectional view showing a state in which a tab is attached to a tab attaching rod, and the blocking member is mounted to a slider body so as to be fixed.

A slider 3 for the slide fastener in accordance with the present embodiment 3 is provided with a slider body 70, a tab attaching rod 80 which is integrally formed in a cantilevered state in the slider body 70, a blocking member 90 which is mounted to the slider body 70, and a tab 5 which is retained to the tab attaching rod 80.

The slider body 70 in the slider 3 has an upper blade 71 and a lower blade (not shown) which are arranged approximately in parallel to each other, a diamond (not shown) which connects front end portions of the upper and lower blades 71, and a flange (not shown) which is provided so as to be hanged in a vertical direction from right and left side edges of the upper blade 71 toward the lower blade.

A step portion 71*a* is provided in an upper surface side of a rear end portion of the upper blade 71 in the slider body 70, and the step portion 71*a* is provided with a pair of right and left protruding portions 71*b*. Further, a dovetail groove 71*c* which can mount the blocking member 90 is formed in the center portion in a lateral direction of the upper blade 71 from the step portion 71*a* toward a forward side. Further, in a portion in which the step portion 71*a* and the dovetail groove 71*c* of the upper blade 71 are arranged, a guide groove 71*d* for fitting a guide portion 97 mentioned later of the blocking member 90 is provided in a concave manner from a rear end of the upper blade 71 toward a forward side.

The tab attaching rod 80 which is integrally formed in the slider body 70 has a fixed end portion 81 which rises from a front end portion of the upper blade 71, an extension portion 82 which is bent from the fixed end portion 81 so as to extend rearward, and a free end portion 83 which formed so as to be bent to a side of the upper blade 71 from the extension portion 82.

Further, an accommodating space 84 which accommodates the attaching shaft portion 5*b* of the tab 5 is formed between a lower end edge in the extension portion 82 of the tab attaching rod 80 and an upper surface of the upper blade 71. Further, the free end portion 83 of the tab attaching rod 80 is arranged such that an insertion gap 85 which can insert the attaching shaft portion 5*b* of the tab 5 is formed with respect to the upper surface of the upper blade 71.

The blocking member 90 in the present embodiment 3 has a main body portion 91 which is fitted and mounted to the dovetail groove 71*c* of the upper blade 71, a blocking portion 92 which is provided in a rising manner in the main body portion 91, a pair of right and left leg portions 95 which are bifurcated toward a rear side from the main body portion 91 so as to be extended, protruding piece portions 96 which protrude in a direction of being spaced from each other in leading ends of the respective leg portions 95, and a guide portion 97 which is provided in a lower surface of the main body portion 91 in a hanged manner.

The main body portion 91 in the blocking member 90 is formed in a tabular shape in such a manner that it can be fitted into the dovetail groove 71*c* arranged in the upper blade 71. The blocking portion 92 in the blocking member 90 is formed in an approximately rectangular parallelepiped shape. In this case, a height of the blocking portion 92 is set to such a magnitude that the upper surface of the blocking portion 92 comes into contact with the free end portion 83 of the tab attaching rod 80 at a time when the blocking member 90 is fixed to the slider body 70.

A pair of right and left leg portions 95 in the blocking member 90 are arranged and inclined with respect to the back and forth direction in such a manner that a distance between the leg portions 95 is increased little by little toward a leading end, and is formed so as to be resiliently deformable in a lateral direction (a slider width direction). Further, in this case, in order to make it easy for the right and left leg portions 95 to be resiliently deformed toward the inner side, it is possible to form a slit having a predetermined magnitude in the inner side of the base end portion in the side of the main body portion 91 in the leg portion 95.

The protruding portion 96 in the blocking member 90 is formed at such a magnitude that it can be fitted into a region of the step portion 71*a* in a forward side of the projection portion 53 which is provided in a protruding manner in the upper blade 71. Further, the protruding piece portion 96 is structured such as to be locked with the protruding portion 71*b* of the upper blade 71 at a time of being fitted to the region of the step portion 71*a*. The guide portion 97 in the blocking member 90 is formed along the back and forth direction, and a width of the guide portion 97 is set in correspondence to a magnitude of a groove width of the guide groove 71*d* which is provided in a concave manner in the upper blade 71.

In the case of assembling the slider 3 in accordance with the present embodiment 3 having the structure mentioned above, first of all, the tab 5 will be retained to the tab attaching rod 80 of the slider body 70. Specifically, in the same manner as the embodiment 1 mentioned above, the attaching shaft portion 5*b* of the tab 5 is introduced to the accommodating space 84 via the insertion gap 85 between the upper surface of the upper blade 71 and the free end portion 83 of the tab attaching rod 80 from the rear side of the slider body 70. In accordance with this, the tab 5 is retained to the tab attaching rod 80.

Next, the blocking member 90 will be mounted and fixed to the slider body 70. In this work, the blocking member 90 is inserted toward the dovetail groove 71*c* of the upper blade 71 from the rear side of the slider body 70, and the main body portion 91 of the blocking member 90 is fitted into the dovetail groove 71*c*. At this time, it is possible to easily carry out the positioning of the blocking member 90 with respect to the slider body 70 by fitting the guide portion 97 of the blocking member 90 to the guide groove 71*d* of the upper blade 71.

Further, the blocking member 90 is pressed toward the forward side while resiliently deforming the right and left leg portions 95 in the slider width direction by pressing the right and left protruding piece portions 96 of the blocking member 90 toward the inner side after fitting the main body portion 91 of the blocking member 90 to the dovetail groove 71*c*. In accordance with this, since the protruding piece portion 96 of the blocking member 90 is locked with the protruding portion 71*b* of the upper blade 71 as shown in FIG. 19, the blocking member 90 is immovably fixed to the upper blade 71 of the slider body 70, and the insertion gap 85 is blocked by the blocking portion 92 of the blocking member 90, whereby the attachment of the tab 5 to the slider body 70 is completed.

In the slider 3 in accordance with the present embodiment 3 in which the blocking member 90 is immovably fixed to the slider body 70, since the main body portion 91 of the blocking member 90 is fitted to the dovetail groove 71*c* of the upper blade 71, and the upper surface of the blocking portion 92 in the blocking member 90 is completely in contact with the free end portion 83 of the tab attaching rod 80, it is possible to stably retain the state in which the insertion gap 85 is blocked by the blocking member 90.

As mentioned above, the slider 3 in accordance with the present embodiment 3 can easily attach the tab 5 afterward to the slider body 70. Further, since the slider 3 can stably retain the blocked state of the insertion gap 85 by the blocking portion 92 of the blocking member 90 which is fixed to the slider body 70, it is possible to securely prevent the other member such as the thin patching from intruding into the insertion gap 85 so as to be pinched.

DESCRIPTION OF REFERENCE NUMERALS

1 slider
2 slider
3 slider
5 tab
5*a* tab main body portion
5*b* attaching shaft portion
7 pressing member
10 slider body
11 upper blade
11*a* concave groove
12 lower blade
13 flange
14 element guide path
20 tab attaching rod
21 fixed end portion
22 extension portion
23 free end portion
23*a* step portion
23*b* chamfer portion
24 accommodating space
25 insertion gap
30 blocking gap
31 main body portion
31*a* left side lever portion
31*b* right side lever portion
31*c* front lever portion resilient piece portion
32*a* concave portion
33 protruding portion
33*a* upper end surface
33*b* rear end surface
33*c* front inclined surface
34 shoulder portion
40 slider body
41 upper blade
41*a* step portion
41*b* protruding portion
41*c* dovetail groove
41*d* guide groove
42 lower blade
43 flange
50 tab attaching rod
51 fixed end portion
52 extension portion
53 free end portion
53*a* notch portion
53*b* projection portion
53*c* post portion
53*d* locking head portion
54 accommodating space
55 insertion gap
60 blocking member
61 main body portion
62 resilient piece portion
63 hole portion
64 lug portion
65 leg portion

66 protruding piece portion
67 guide portion
70 slider body
71 upper blade
71*a* step portion
71*b* protruding portion
71*c* dovetail groove
71*d* guide groove
80 tab attaching rod
81 fixed end portion
82 extension portion
83 free end portion
84 accommodating space
85 insertion gap
90 blocking member
91 main body portion
92 blocking portion
95 leg portion
96 protruding piece portion
97 guide portion

The invention claimed is:

1. A slider for a slide fastener wherein a tab attaching rod retaining a tab is integrally formed in a cantilevered state on an upper surface of an upper blade of a slider body having the upper blade and lower blade, the tab attaching rod has a fixed end portion which rises from the upper blade, and a free end portion which provides an insertion gap capable of receiving a part of the tab with respect to the upper blade, a blocking member blocking the insertion gap when arranged in the slider body, the slider body has a mounting portion for mounting a part of the blocking member, the mounting portion includes a concave groove on the upper surface of the upper blade, the concave groove is provided across the insertion gap from the free end portion of the tab attaching rod, the concave groove includes a bottom surface which is lower than the upper surface of the upper blade, a pair of right and left side surfaces which rise from the bottom surface and face each other, and a front surface which rises from the bottom surface and is formed between the right and left side surfaces, and the concave groove extends from a rear end of the upper blade toward a front end of the upper blade, wherein when the blocking member is mounted to the concave groove the blocking member is firmly fixed, wherein the slider is provided with an occlusion retaining structure which retains a blocked state of the insertion gap when the blocking member is firmly fixed, wherein the tab attaching rod has a fixing portion which engages at least a part of the blocking member when the blocking member is mounted to the concave groove so as to fix the blocking member with respect to the free end portion, the blocking member has a main body portion which is mounted to the mounting portion, a resilient piece portion which is configured to be resiliently deformable in an up and down direction, and an engaging and disengaging portion which is arranged in the resilient piece portion and is capable of engaging with and disengaging from the fixing portion, wherein the occlusion retaining structure includes the engaging and disengaging portion and the fixing portion, wherein the fixing portion is constructed by a step portion which is arranged in the free end portion, the resilient piece portion is arranged in such a manner that a part of the resilient piece portion is in contact with or close to the free end portion of the tab attaching rod when the block member is firmly fixed, the engaging and disengaging portion includes a protruding portion which protrudes from an upper surface of the resilient piece portion, and wherein an upper end of the protruding portion is movable to a height position of a lower end of the step portion.

2. The slider for the slide fastener according to claim 1, wherein the blocking member has a pair of shoulder portions, and the resilient piece portion and the protruding portion are arranged within a region between the pair of shoulder portions.

3. The slider for a slide fastener according to claim 2, wherein a body portion of the blocking member includes a left side lever portion and a right side lever portion and a front lever portion connecting front edges of the left and right side lever portions, and outer side surfaces of the shoulder portions are on same planes as outer side surfaces of the left and right side lever portions, respectively.

4. The slider for the slide fastener according to claim 1, wherein a concave portion is arranged in an upper surface of the resilient piece portion.

5. The slider for the slide fastener according to claim 1, wherein the concave groove is formed at a center part in a width direction of the upper blade.

6. The slider for the slide fastener according to claim 1, wherein the fixed end portion of the tab attaching rod rises from a region closer to a shoulder port side than a rear port side on the upper surface of the upper blade, and the concave groove is formed on a region closer to the rear port side than the fixed end portion of the tab attaching rod.

7. The slider for a slide fastener according to claim 1, wherein a maximum dimension in a width direction of the blocking member is smaller than a dimension between the side surfaces forming the concave groove.

8. A slider for a slide fastener wherein a tab attaching rod retaining a tab is integrally formed in a cantilevered state on an upper surface of an upper blade of a slider body having the upper blade and lower blade, the tab attaching rod has a fixed end portion which rises from the upper blade, and a free end portion which provides an insertion gap capable of receiving a part of the tab with respect to the upper blade, a blocking member blocking the insertion gap when arranged in the slider body, the slider body has a mounting portion for mounting a part of the blocking member, the mounting portion includes a concave groove on the upper surface of the upper blade, the concave groove is provided across the insertion gap from the free end portion of the tab attaching rod, the concave groove includes a bottom surface which is lower than the upper surface of the upper blade, a pair of right and left side surfaces which rise from the bottom surface and face each other, and a front surface which rises from the bottom surface and is formed between the right and left side surfaces, and the concave groove extends from a rear port of the upper blade toward a shoulder port of the upper blade, the blocking member has a main body portion which is mounted to the concave groove of the upper blade, a resilient piece portion integrally extends from the main body portion and can be resiliently deformed in an up and down direction with respect to the main body portion, and a pair of right and left shoulder portions which are arranged on both sides of the resilient piece portion and on an upper surface of the main body portion, wherein the slider is provided with an occlusion retaining structure which retains a blocked state of the insertion gap when the blocking member is fixed.

9. The slider for the slide fastener according to claim 8, wherein the tab attaching rod has a fixing portion in the free end portion which engages at least a part of the resilient piece portion of the blocking member when the blocking member is mounted to the concave groove, and wherein the resilient piece portion includes an engaging and disengaging portion which is capable of engaging with and disengaging from the fixing portion.

10. The slider for the slide fastener according to claim 9, wherein an upper end surface of the engaging and disengaging portion is positioned higher than a lowest edge of the free end portion of the tab attaching rod when the blocking member is fixed.

11. The slider for the slide fastener according to claim 8, wherein the resilient piece portion is arranged within a region between the pair of shoulder portions.

12. The slider for the slide fastener according to claim 8, wherein the tab attaching rod has a fixing portion in the free end portion that includes a step portion, and wherein the resilient piece portion includes a protruding portion which protrudes from an upper surface of the resilient piece portion.

13. The slider for the slide fastener according to claim 8, wherein outer side surfaces of the main body portion and the shoulder portion in the blocking member are disposed between the pair of right and left side surfaces of the concave groove.

* * * * *